US012011638B2

(12) United States Patent
Rogus et al.

(10) Patent No.: US 12,011,638 B2
(45) Date of Patent: Jun. 18, 2024

(54) EXERCISE MACHINES FOR FACILITATING ELLIPTICAL STRIDING MOTION

(71) Applicant: Life Fitness, LLC, Rosemont, IL (US)

(72) Inventors: John M. Rogus, Northbrook, IL (US); William J. Kreuger, Bloomingdale, IL (US)

(73) Assignee: Life Fitness, LLC, Franklin Park, IL (US)

( * ) Notice: Subject to any disclaimer, the term of this patent is extended or adjusted under 35 U.S.C. 154(b) by 123 days.

(21) Appl. No.: 17/191,923

(22) Filed: Mar. 4, 2021

(65) Prior Publication Data

US 2021/0275866 A1 Sep. 9, 2021

Related U.S. Application Data

(60) Provisional application No. 62/987,042, filed on Mar. 9, 2020.

(51) Int. Cl.
*A63B 22/06* (2006.01)
*A63B 22/00* (2006.01)

(52) U.S. Cl.
CPC ..... *A63B 22/0664* (2013.01); *A63B 22/001* (2013.01); *A63B 22/0015* (2013.01); *A63B 2022/067* (2013.01)

(58) Field of Classification Search
CPC ..... A63B 2022/002; A63B 2022/0676; A63B 2022/0682; A63B 2022/0664;
(Continued)

(56) References Cited

U.S. PATENT DOCUMENTS 2,641,249 A 6/1953 Brockman
3,316,898 A 5/1967 Brown
(Continued)

FOREIGN PATENT DOCUMENTS

| | | |
|---|---|---|
| EP | 2223722 | 9/2010 |
| TW | I579019 | 4/2017 |
| WO | 2008114291 | 9/2008 |

OTHER PUBLICATIONS

Hybrid Generator Brake (FB6), Chi Hua Fitness Co., http://www.chihua.com.tw/zh-tw/product, date website visited Jun. 25, 2018.

*Primary Examiner* — Loan B Jimenez
*Assistant Examiner* — Kathleen M Fisk
(74) *Attorney, Agent, or Firm* — Andrus Intellectual Property Law, LLP

(57) ABSTRACT

An exercise machine is for performing a striding exercise motion. The exercise machine has a frame; first and second pedal members; first and second foot pads on the first and second pedal members, respectively, each of the first and second foot pads being movable along an elliptical path during said striding exercise motion; and first and second rocker arms each having a first end that is pivotable with respect to the frame about a rocker arm pivot axis and further having a second end that is pivotable with respect to one of the first and second pedal members about a pedal lever hub axis. The frame has first and second frame portions. The first frame portion supports the first and second rocker arms and is pivotable about a frame pivot axis relative to the second frame portion. Pivoting the first frame portion relative to the second frame portion adjusts a position of the rocker arm pivot axis, which thereby changes a shape of the elliptical path.

20 Claims, 14 Drawing Sheets

(58) Field of Classification Search
CPC . A63B 22/00; A63B 22/0002; A63B 22/0015; A63B 22/0017; A63B 22/0076; A63B 22/0005; A63B 22/0007; A63B 22/001; A63B 22/0012; A63B 23/12; A63B 22/0664; A63B 22/0023; A63B 2022/067–0688
USPC ..... 482/51
See application file for complete search history.

(56) References Cited

U.S. PATENT DOCUMENTS 3,917,261 A 11/1975 Small et al.
4,376,532 A 3/1983 Hunstad
4,408,613 A 10/1983 Relyea
4,587,960 A 5/1986 Schotten
4,786,050 A 11/1988 Geschwender
4,915,375 A 4/1990 Ginsburg
5,067,710 A 11/1991 Watterson et al.
5,135,447 A 8/1992 Robards, Jr. et al.
5,149,084 A 9/1992 Dalebout et al.
5,242,343 A 9/1993 Miller
5,290,211 A 3/1994 Stearns
5,383,829 A 1/1995 Miller
5,411,454 A 5/1995 Chang
5,419,751 A 5/1995 Byrd et al.
5,478,295 A 12/1995 Fracchia
5,499,956 A 3/1996 Habing et al.
5,540,637 A * 7/1996 Rodgers, Jr. ..... B62M 1/26 482/52
5,562,574 A 10/1996 Miller
5,573,480 A 11/1996 Rodgers, Jr.
5,624,356 A 4/1997 Roberts
5,685,804 A 11/1997 Tong et al.
5,743,834 A 4/1998 Rodgers, Jr.
5,759,136 A 6/1998 Chen
5,762,588 A 6/1998 Chen
5,779,599 A 7/1998 Chen
5,785,632 A 7/1998 Greenberg et al.
5,788,610 A 8/1998 Eschenbach
5,792,026 A 8/1998 Maresh et al.
5,803,871 A 9/1998 Stearns et al.
5,836,854 A 11/1998 Kuo
5,836,855 A 11/1998 Eschenbach
5,848,954 A 12/1998 Stearns et al.
5,857,941 A 1/1999 Maresh et al.
5,882,281 A 3/1999 Stearns et al.
5,893,820 A 4/1999 Maresh
5,895,339 A 4/1999 Maresh
5,899,833 A 5/1999 Ryan et al.
5,919,118 A 7/1999 Stearns et al.
5,921,894 A 7/1999 Eschenbach
5,928,113 A 7/1999 Roberts
5,938,568 A 8/1999 Maresh et al.
5,947,872 A 9/1999 Ryan et al.
5,957,814 A 9/1999 Eschenbach
5,993,359 A 11/1999 Eschenbach
6,007,462 A 12/1999 Chen
6,027,430 A 2/2000 Stearns et al.
6,027,431 A 2/2000 Stearns et al.
6,030,320 A 2/2000 Stearns et al.
6,042,512 A 3/2000 Eschenbach
6,045,488 A 4/2000 Eschenbach
6,053,847 A 4/2000 Stearns et al.
6,063,008 A 5/2000 McBride et al.
6,063,009 A 5/2000 Stearns et al.
6,077,196 A * 6/2000 Eschenbach ..... A63B 22/001 482/57
6,077,197 A 6/2000 Stearns et al.
6,077,198 A 6/2000 Eschenbach
6,080,086 A 6/2000 Maresh et al.
6,090,013 A 7/2000 Eschenbach
6,090,014 A * 7/2000 Eschenbach ..... A63B 22/0023 482/52
6,099,439 A 8/2000 Ryan et al.
6,113,518 A 9/2000 Maresh et al.
6,126,574 A 10/2000 Stearns et al.
6,135,923 A 10/2000 Stearns et al.
6,146,313 A 11/2000 Tong et al.
6,168,552 B1 1/2001 Eschenbach
6,171,215 B1 1/2001 Stearns et al.
6,176,814 B1 1/2001 Ryan et al.
6,196,948 B1 3/2001 Stearns et al.
6,203,474 B1 3/2001 Jones
6,206,804 B1 3/2001 Maresh
6,210,305 B1 4/2001 Eschenbach
6,217,485 B1 4/2001 Maresh
6,217,486 B1 4/2001 Rosenow
6,248,044 B1 6/2001 Stearns et al.
6,248,045 B1 6/2001 Stearns et al.
6,248,046 B1 6/2001 Maersh et al.
6,254,514 B1 7/2001 Maersh et al.
6,277,054 B1 8/2001 Kuo
6,283,895 B1 9/2001 Stearns et al.
6,302,825 B1 10/2001 Stearns et al.
6,302,830 B1 10/2001 Stearns
6,312,362 B1 11/2001 Maresh et al.
6,334,836 B1 1/2002 Technogym
6,338,698 B1 1/2002 Stearns et al.
6,340,340 B1 1/2002 Stearns et al.
6,361,476 B1 3/2002 Eschenbach
6,387,017 B1 5/2002 Maresh
6,390,953 B1 5/2002 Maresh et al.
6,416,442 B1 7/2002 Stearns et al.
6,422,977 B1 7/2002 Eschenbach
6,436,007 B1 8/2002 Eschenbach
6,440,042 B2 8/2002 Eschenbach
6,450,922 B1 9/2002 Henderson et al.
6,450,925 B1 9/2002 Kuo
6,454,682 B1 9/2002 Kuo
6,458,060 B1 10/2002 Watterson et al.
6,461,277 B2 10/2002 Maresh et al.
6,482,130 B1 11/2002 Pasero et al.
6,516,683 B2 2/2003 Sundaresan et al.
6,540,646 B2 * 4/2003 Stearns ..... A63B 22/0017 482/52
6,544,146 B1 4/2003 Stearns et al.
6,547,701 B1 4/2003 Eschenbach
6,554,750 B2 4/2003 Stearns et al.
6,565,486 B2 5/2003 Stearns et al.
6,569,061 B2 5/2003 Stearns et al.
6,579,210 B1 6/2003 Stearns et al.
6,610,382 B1 8/2003 Kobe et al.
6,612,969 B2 9/2003 Eschenbach
6,620,079 B2 9/2003 Kuo
6,629,909 B1 10/2003 Stearns et al.
6,645,125 B1 * 11/2003 Stearns ..... A63B 22/0015 482/52
6,672,992 B1 1/2004 Lo et al.
6,689,020 B2 2/2004 Stearns et al.
6,726,600 B2 4/2004 Miller
6,758,115 B2 7/2004 Allen et al.
6,830,538 B2 12/2004 Eschenbach
6,846,272 B2 1/2005 Rosenow et al.
6,905,442 B1 6/2005 Lee et al.
6,991,587 B1 1/2006 Eschenbach
6,997,852 B2 2/2006 Watterson et al.
7,025,711 B2 4/2006 Eschenbach
7,033,305 B1 4/2006 Stearns et al.
7,037,242 B2 5/2006 Lo et al.
7,041,034 B1 * 5/2006 Stearns ..... A63B 22/0012 482/52
7,052,438 B2 5/2006 Eschenbach
7,060,004 B2 6/2006 Kuo
7,097,591 B2 8/2006 Moon
7,097,592 B2 8/2006 Wang
7,101,316 B2 9/2006 Rosenow et al.
7,131,935 B2 11/2006 Wang
7,153,239 B1 12/2006 Stearns et al.
7,169,088 B2 1/2007 Rodgers, Jr.
7,169,090 B1 1/2007 Maresh
7,264,576 B2 9/2007 Gerschefske et al.
7,270,626 B2 9/2007 Porth
7,270,628 B2 9/2007 Campanaro et al.

(56) References Cited

U.S. PATENT DOCUMENTS 7,344,480 B2 3/2008 Maresh et al.
7,361,122 B2 4/2008 Porth
7,435,202 B2 10/2008 Daly et al.
7,448,986 B1 * 11/2008 Porth ..... A63B 22/001 482/52
7,455,624 B2 11/2008 Liao Lai
7,507,186 B2 3/2009 Stearns et al.
7,559,879 B2 7/2009 Anderson et al.
7,670,268 B1 3/2010 Stearns et al.
7,682,290 B2 3/2010 Liao et al.
7,691,035 B2 * 4/2010 Chen ..... A63B 22/0015 482/52
7,708,669 B2 5/2010 Rodgers, Jr.
7,722,505 B2 5/2010 Liao et al.
7,740,564 B2 * 6/2010 Shen ..... A63B 22/0664 482/52
7,749,137 B2 7/2010 Watt et al.
7,758,473 B2 7/2010 Lull et al.
7,785,235 B2 8/2010 Lull et al.
7,803,089 B2 9/2010 Roimicher et al.
7,811,206 B2 10/2010 Chuang et al.
7,878,949 B2 2/2011 Chen
7,918,766 B2 4/2011 Lu et al.
7,931,566 B1 4/2011 Radke et al.
8,021,274 B2 9/2011 Anderson et al.
8,079,937 B2 12/2011 Bedell et al.
8,092,349 B2 1/2012 Liao et al.
8,133,159 B2 3/2012 Eschenbach
8,235,873 B1 8/2012 Stearns et al.
8,272,997 B2 9/2012 Anderson et al.
8,376,913 B2 2/2013 Lee et al.
8,403,815 B2 3/2013 Liao et al.
8,419,598 B2 4/2013 Dyer et al.
8,449,437 B1 5/2013 Maresh et al.
8,540,609 B2 9/2013 Anderson et al.
8,668,627 B2 3/2014 Eschenbach
8,827,870 B2 9/2014 Dyer et al.
8,864,631 B1 10/2014 Stearns et al.
9,038,577 B1 5/2015 Lankinen
9,039,577 B2 5/2015 Peng
9,044,640 B2 * 6/2015 Lo ..... A63B 22/0023
9,050,498 B2 6/2015 Lu et al.
9,126,078 B2 9/2015 Anderson et al.
9,138,614 B2 9/2015 Lu et al.
9,283,425 B2 3/2016 Lu et al.
9,339,684 B2 5/2016 Liao et al.
9,381,394 B2 * 7/2016 Mortensen ..... A63B 22/0002
9,403,585 B2 8/2016 Arad
9,586,085 B2 3/2017 Arnold et al.
9,604,096 B2 3/2017 Arnold et al.
9,764,187 B1 9/2017 Stearns et al.
9,808,667 B2 * 11/2017 Liao ..... A63B 69/0057
9,925,412 B1 3/2018 Lu
10,201,727 B2 2/2019 Ohrt et al.
10,252,101 B2 4/2019 Yim et al.
10,369,403 B2 8/2019 Liao et al.
10,478,665 B1 11/2019 Daly et al.
10,532,246 B2 * 1/2020 Liao ..... A63B 21/225
10,543,396 B2 1/2020 Yim et al.
10,561,891 B2 2/2020 Luger et al.
10,653,914 B2 * 5/2020 Ellis ..... A63B 22/0664
10,946,238 B1 * 3/2021 Rogus ..... A63B 22/001
2001/0051562 A1 12/2001 Stearns et al.
2002/0019298 A1 2/2002 Eschenbach
2002/0032104 A1 3/2002 Rosenow et al.
2002/0055420 A1 5/2002 Stearns et al.
2002/0077220 A1 6/2002 Kuo
2002/0094914 A1 7/2002 Maresh et al.
2002/0119867 A1 8/2002 Stearns et al.
2002/0142890 A1 10/2002 Ohrt et al.
2002/0151411 A1 10/2002 Stearns et al.
2002/0198084 A1 12/2002 Stearns et al.
2003/0027690 A1 2/2003 Miller
2003/0045401 A1 * 3/2003 Watterson ..... A63B 22/0017 482/51
2004/0097339 A1 5/2004 Moon
2004/0209741 A1 10/2004 Kuo
2005/0028660 A1 2/2005 Chin-Chin
2005/0043148 A1 2/2005 Maresh
2005/0049118 A1 3/2005 Rosenow et al.
2005/0085344 A1 4/2005 Eschenbach
2005/0124466 A1 6/2005 Rodgers
2005/0164837 A1 7/2005 Anderson et al.
2005/0181911 A1 8/2005 Porth
2005/0209056 A1 9/2005 Daly et al.
2005/0245361 A1 11/2005 Wu et al.
2006/0189446 A1 * 8/2006 Rogus ..... A63B 22/0664 482/52
2006/0247103 A1 11/2006 Stearns et al.
2006/0281604 A1 * 12/2006 Stewart ..... A63B 22/0023 482/52
2007/0032350 A1 2/2007 Alessandri et al.
2007/0037666 A1 2/2007 Gagnon et al.
2007/0087903 A1 4/2007 Lee et al.
2007/0117683 A1 5/2007 Ercanbrack et al.
2007/0179023 A1 8/2007 Dyer
2007/0238582 A1 10/2007 Lee
2007/0298936 A1 12/2007 Ohrt et al.
2008/0051258 A1 2/2008 Schmehl et al.
2008/0200314 A1 * 8/2008 Dalebout ..... A63B 22/0664 482/52
2008/0280731 A1 * 11/2008 Dalebout ..... A63B 22/001 482/52
2008/0280735 A1 * 11/2008 Dickie ..... A63B 22/001 482/62
2008/0300114 A1 * 12/2008 Dalebout ..... A63B 22/0664 482/52
2009/0291809 A1 11/2009 Chen
2010/0167877 A1 * 7/2010 Grind ..... A63B 22/001 482/52
2010/0248899 A1 * 9/2010 Bedell ..... A63B 22/001 482/4
2010/0317492 A1 * 12/2010 Nelson ..... A63B 22/0664 482/52
2012/0190507 A1 * 7/2012 Murray ..... A63B 22/001 482/52
2013/0210585 A1 8/2013 Arnold
2013/0310225 A1 * 11/2013 Johnson ..... A63B 22/203 482/52
2014/0194254 A1 * 7/2014 Huang ..... A63B 22/001 482/52
2014/0309086 A1 10/2014 Chuang
2015/0087481 A1 * 3/2015 Liu ..... A63B 22/0015 482/52
2015/0238807 A1 * 8/2015 Long ..... A63B 22/001 482/52
2015/0343262 A1 * 12/2015 Su ..... A63B 22/203 482/8
2016/0158595 A1 6/2016 Dalebout
2016/0339295 A1 11/2016 Lin
2017/0274244 A1 9/2017 Chang et al.
2018/0036582 A1 * 2/2018 Liao ..... A63B 22/0664
2018/0111019 A1 4/2018 Ellis et al.
2020/0346069 A1 11/2020 Tracy
2021/0275866 A1 * 9/2021 Rogus ..... A63B 22/0664
2023/0025399 A1 1/2023 Rogus

* cited by examiner

EXERCISE MACHINES FOR FACILITATING ELLIPTICAL STRIDING MOTION

CROSS-REFERENCE TO RELATED APPLICATION

The present application claims the benefit of and priority to U.S. Provisional Application Ser. No. 62/987,042, filed Mar. 9, 2020, which application is hereby incorporated by reference in its entirety.

FIELD

The present disclosure relates to exercise machines, and particularly to exercise machines that facilitate an elliptical striding motion by a user.

BACKGROUND

The following U.S. Patents are incorporated herein by reference:

U.S. Pat. No. 10,478,665 discloses an exercise apparatus having a frame and first and second pedals that are coupled to the frame such that a user standing on the first and second pedals can perform a striding exercise. The first and second pedals each have a tread member that supports the bottom of a user's foot in a manner that encourages movement of the user's foot relative to the tread member during the striding exercise.

U.S. Pat. No. 9,925,412 discloses an exercise device including a linkage assembly that links a driving member to a driven member such that circular rotation of the driving member causes generally equal circular rotation of the driven member. The linkage assembly includes a linking member, a first crank arm that connects the driving member to the linking member such that rotation of the driving member causes motion of the linking member, and a second crank arm that connects the linking member to the driven member such that the motion of the linking member causes rotation of the driven member. At least one additional crank arm connects the linking member at a rotational axis that is laterally offset from a straight line through the first and second crank arm rotational axes.

U.S. Pat. No. 9,283,425 discloses an exercise assembly having a frame and elongated foot pedal members that are each movable along user-defined paths of differing dimensions. Each foot pedal member has a front portion and a rear portion. Footpads are disposed on the rear portion of one of the first and second foot pedal members. Elongated coupler arms have a lower portion and an upper portion that is pivotally connected to the frame. Crank members have a first portion that is pivotally connected to the front portion of one of the first and second foot pedal members and have a second portion that is pivotally connected to the lower portion of one of the first and second coupler arms, such that each crank member is rotatable in a circular path. Elongated rocker arms have a lower portion that is pivotally connected to one of the first and second foot pedal members in between the foot pad and the crank member and have an upper portion that is pivotally connected to the frame.

U.S. Pat. No. 9,138,614 discloses an exercise assembly having elongated first and second rocker arms that pivot with respect to each other in a scissors-like motion about a first pivot axis. A slider has a slider body that slides along a linear axis extending through and perpendicular to the first pivot axis. A linkage pivotally couples the first and second rocker arms to the slider body. Pivoting the first and second rocker arms with respect to each other causes the slider body to slide in a first direction along the linear axis. Opposite pivoting of the first and second rocker arms with respect to each other causes the slider body to slide in an opposite, second direction along the linear axis.

U.S. Pat. Nos. 9,126,078 and 8,272,997 and 8,021,274 disclose an elliptical step exercise apparatus in which a dynamic link mechanism can be used to vary the stride length of the machine. A control system can also be used to vary stride length as a function of various exercise and operating parameters such as speed and direction as well as varying stride length as a part of a preprogrammed exercise routine such as a hill or interval training program. In addition, the control system can use measurements of stride length to optimize operation of the apparatus.

U.S. Pat. No. 7,931,566 discloses an elliptical cross trainer that has a rotating inertial flywheel driven by user-engaged linkage exercising a user. A user-actuated brake engages and stops rotation of the flywheel upon actuation by the user.

U.S. Pat. No. 7,918,766 discloses an exercise apparatus for providing elliptical foot motion that utilizes a first and second rocking links suspended from an upper portion of the apparatus frame permitting at least limited arcuate motion of the lower portions of the links. Foot pedal assemblies are connected to rotating shafts or members located on the lower portion of the links such that the foot pedals will describe a generally elliptical path in response to user foot motion on the pedals.

U.S. Pat. No. 6,846,272 discloses an exercise apparatus having a frame that is adapted for placement on the floor, a pivot axle supported by the frame, a first and second pedal levers, pedals secured to the pedal levers, and arm handles connected for motion with the pedal levers and which can utilize a variety of pedal actuation assemblies for generating elliptical motion of the pedal. The stride length portion of the elliptical motion can be increased automatically as a function of exercise parameters such as speed. In addition, the arm handles can be disconnected manually or automatically from the pedal levers.

U.S. Pat. No. 6,217,486 discloses an exercise apparatus that includes a frame adapted for placement on the floor, a pivot axle supported by the frame, a bent pedal lever, a pedal that is secured to the bent pedal lever and a variety of pedal actuation assemblies. These pedal actuation assemblies include components which cooperate to provide an elliptical path and provide the desired foot flexure and weight distribution on the pedal. Consequently, as the pedal moves in its elliptical path, the angular orientation of the pedal, relative to a fixed, horizontal plane, such as the floor, varies in a manner that simulates a natural heel to toe flexure.

U.S. Pat. Nos. 6,203,474; 6,099,439; and 5,947,872 disclose an exercise apparatus including a frame that is adapted for placement on the floor, a pivot axis supported by the frame, a pedal bar which has first and second ends, a pedal that is secured to the pedal bar, an ellipse generator, and a track. The ellipse generator is secured to both the pivot axis and to the first end of the pedal bar such that the first end of said pedal bar moves in an elliptical path around the pivot axis. The track is secured to the frame and engages the second end of said pedal bar such that the second end moves in a linear reciprocating path as the first end of the pedal bar moves in the elliptical path around said pivot axis. Consequently, the pedal also moves in a generally elliptical path. As the pedal moves in its elliptical path, the angular orientation of the pedal, relative to a fixed, horizontal plane, such as the floor, varies in a manner that simulates a natural heel to toe flexure.

U.S. Pat. No. 5,899,833 discloses an exercise apparatus including a frame, a pivot axis supported by the frame, a pedal lever, a coupler for pivotally coupling a first end of the pedal lever to the pivot axis at a predetermined distance from the pivot axis such that the first end moves in an arcuate pathway around the pivot axis, a guide member supported by the frame and engaging a second end of the pedal lever such that the second end of the pedal lever moves in a reciprocating pathway as the first end of the pedal lever moves in the arcuate pathway, and a pedal having a toe portion and a heel portion, the pedal being pivotally coupled with the second end of the pedal lever such that the toe portion is intermediate the heel portion and the pivot axis and the heel portion is raised above the toe portion when the second end moves in the reciprocating pathway in a direction away from the pivot axis.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

An exercise machine is for performing a striding exercise motion. The exercise machine has a frame; first and second pedal members; first and second foot pads on the first and second pedal members, respectively, each of the first and second foot pads being movable along an elliptical path during the striding exercise motion; and first and second rocker arms each having a first end that is pivotable with respect to the frame about a rocker arm pivot axis and further having a second end that is pivotable with respect one of the first and second pedal members about a pedal lever hub axis. The frame has first and second frame portions. The first frame portion supports the first and second rocker arms and is pivotable about a frame pivot axis relative to the second frame portion. Pivoting the first frame portion relative to the second frame portion adjusts a position of the rocker arm pivot axis, which thereby changes a shape of the elliptical path.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the figures and described below.

During research and development, the present applicant determined that it would be desirable to provide an exercise machine for performing an elliptical striding motion, wherein the user's foot path and/or orientation of the elliptical path travelled by the machine can be adjusted and set based upon the user's preferences and/or based upon a certain exercise routine. The present applicant further determined that it would be desirable to provide such an exercise machine with a robust design that avoids use of tracks or linear rollers/guides, which can be noisy and expensive, and subject to breakdown. The present applicant has also determined it would be desirable to design such a machine with a small footprint compared to prior art machines. The present disclosure is a result of these endeavors.

Figure 1:
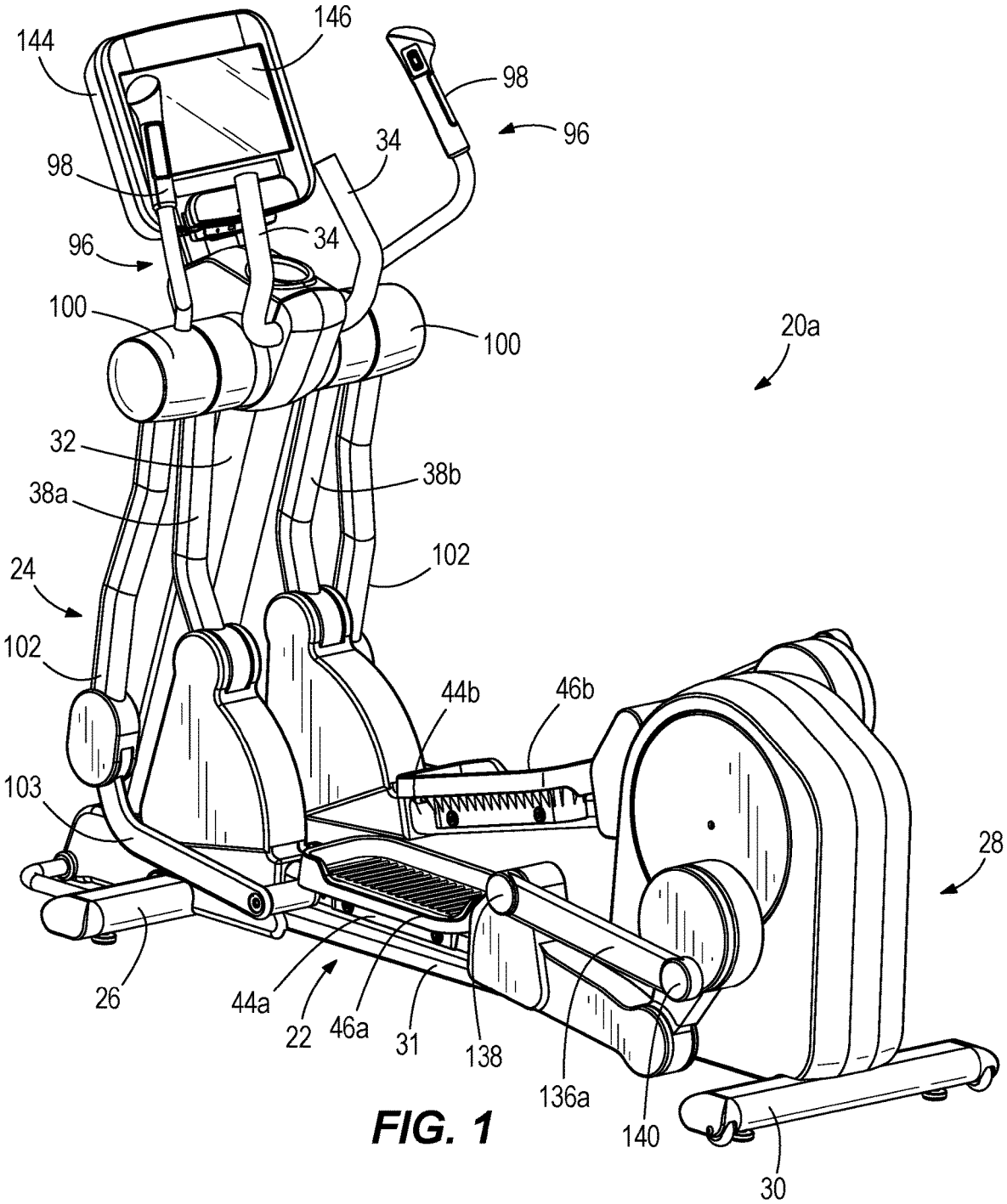
FIG. 1 is a perspective view of a first embodiment of an exercise machine having adjustment devices for adjusting an elliptical striding motion of the user.

FIG. 1 depicts an exercise machine 20*a* for performing a striding exercise motion. The exercise machine 20*a* includes a frame 22 having a front frame portion 24 with laterally extending leg braces 26 and a rear frame portion 28 with laterally extending leg braces 30. A base member 31 longitudinally and from the front frame portion 24 to the rear frame portion 28. A support column 32 extends upwardly from the front frame portion 24 and supports stationary handles 34 for manually grasping by a user performing the striding exercise motion. A stationary shaft 36 (see FIG. 6) extends laterally from the support column 32 at a location proximate to the stationary handles 34. The type and configuration of the frame 22 and stationary handles 34 is merely exemplary and can vary from what is shown.

Figure 2:
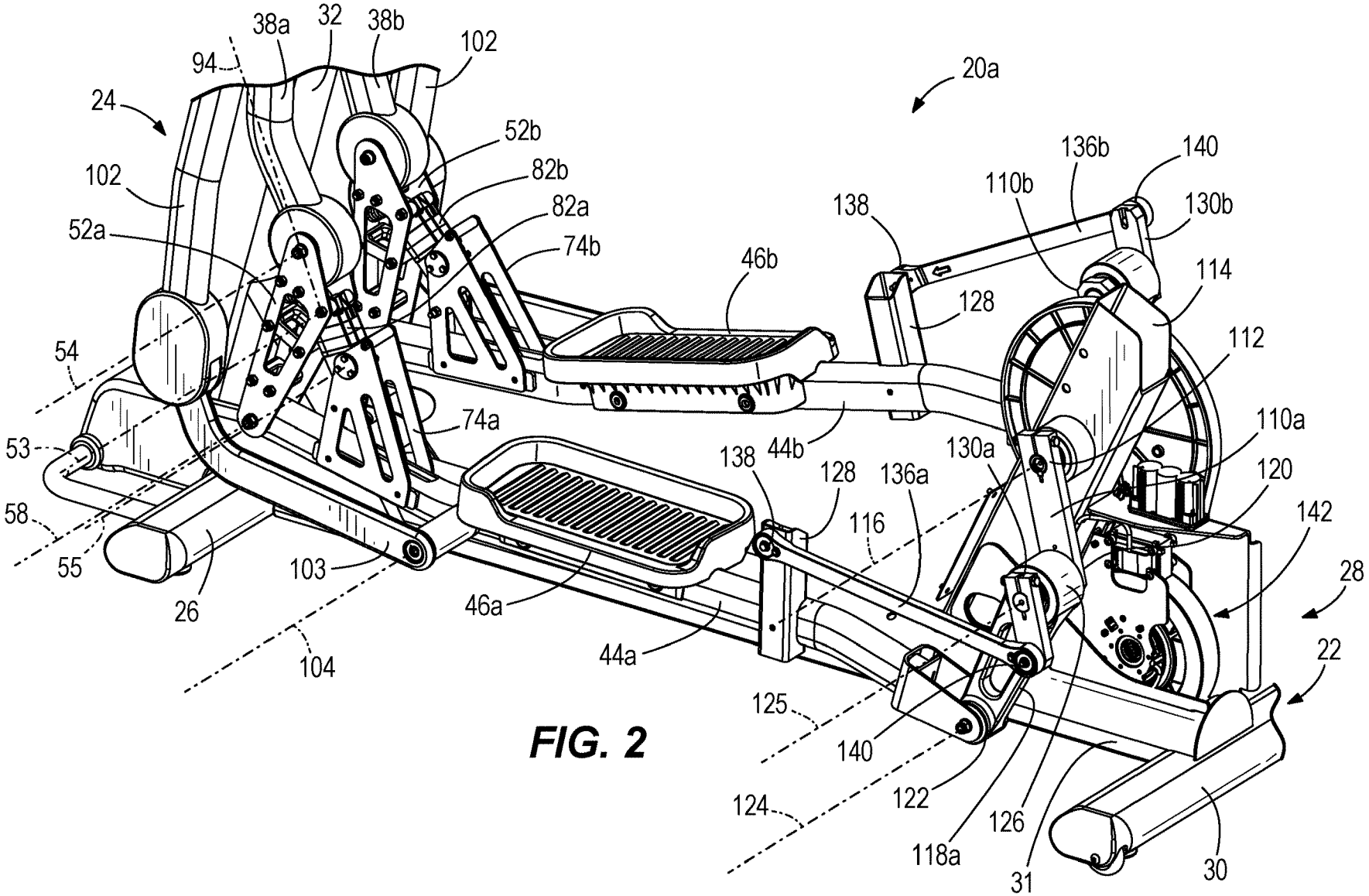
FIG. 2 is a perspective view of a lower portion of the exercise machine having outer shrouds removed.

Referring to FIGS. 1 and 2, first and second rocker arms 38*a*, 38*b* have upper ends that are attached to and pivotally depend from opposite sides of the stationary shaft 36 relative to the support column 32. The upper ends have bearings that are journaled about the stationary shaft 36 and configured so that the rocker arms 38*a*, 38*b* can rotate back and forth with respect to the stationary shaft 36 as the user performs the striding exercise motion. The exercise machine 20*a* also has first and second pedal members 44*a*, 44*b* that longitudinally extend with respect to the frame 22. The pedal members 44*a*,

44*b* support first and second foot pads 46*a*, 46*b* which support the user's feet during the striding exercise motion. The type and configuration of the foot pads 46*a*, 46*b* can vary from what is shown. Examples of suitable foot pads are described in U.S. Pat. No. 10,478,665. In general, the foot pads 46*a*, 46*b* include a tread surface for engagement by the user's feet and a base frame that supports the tread surface with respect to the respective pedal members 44*a*, 44*b*. As will be further described herein below, the exercise machine 20*a* is configured such that the foot pads 46*a*, 46*b* and the corresponding user's feet move in an elliptical path during the striding exercise motion. The exercise machine 20*a* is further configured so that the user and/or a controller associated with the exercise machine 20*a* can actively vary the shape of the elliptical path, as will be further described with reference to FIGS. 4-6.

Figure 3:
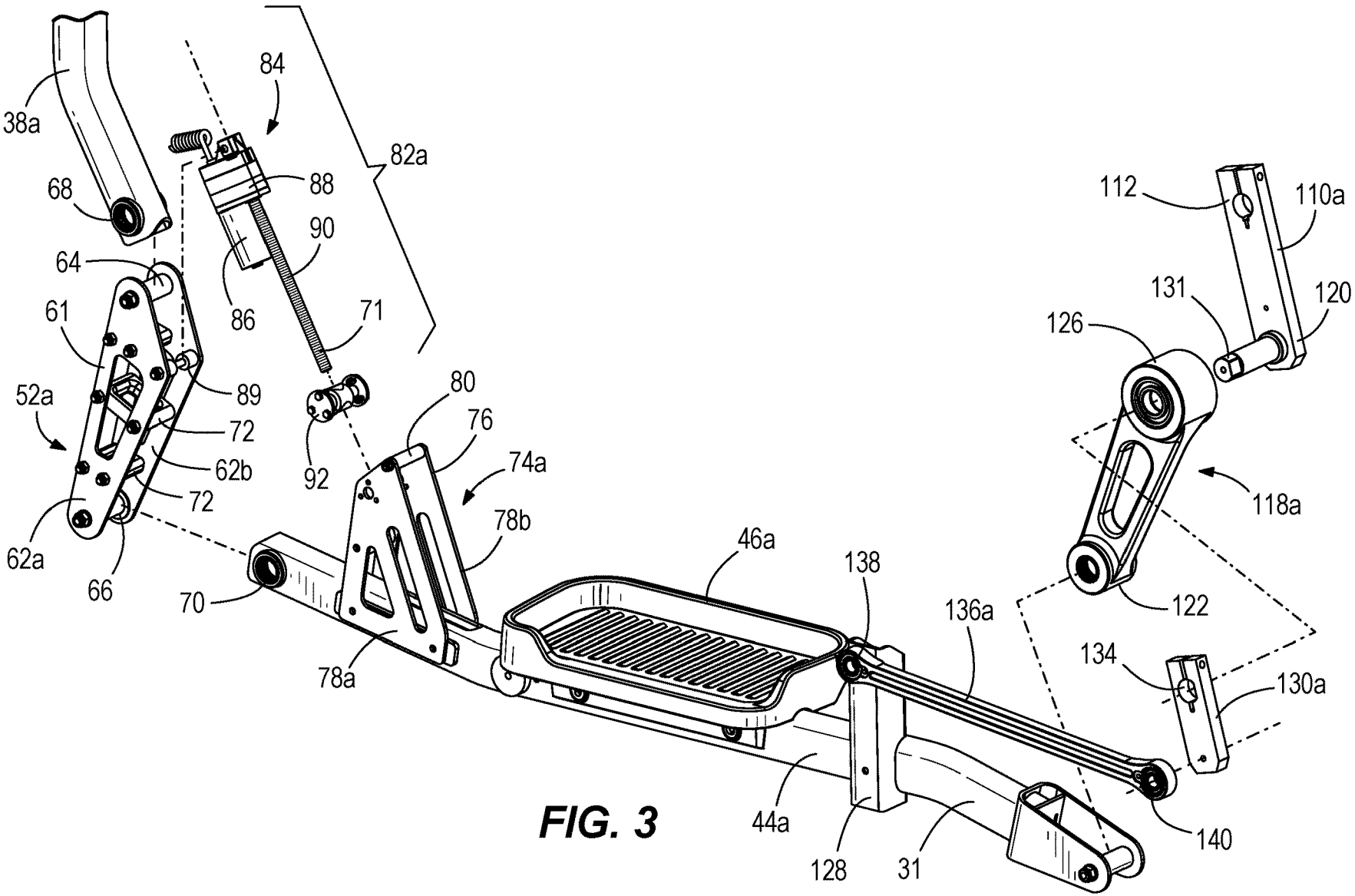
FIG. 3 is an exploded view of portions of the first embodiment.

Referring to FIGS. 2 and 3, first and second front link arms 52*a*, 52*b* are pivotally coupled at a first pivot axis 54 to a lower portion of a respective one of the rocker arms 38*a*, 38*b*, and pivotally coupled at a second pivot axis 58 to a forward portion of a respective one of the pedal members 44*a*, 44*b*. In the illustrated embodiment, the front link arms 52*a*, 52*b* each include a frame member 61 having opposing sides 62*a*, 62*b* and top and bottom pivot pins 64, 66 that extend through cross bores 68, 70 in the respective one of the rocker arms 38*a*, 38*b* and the respective one of the pedal members 44*a*, 44*b*. Supporting ribs 72 extend between the opposing sides 62*a*, 62*b* of the frame member 61. The front link arms 52*a*, 52*b* can be a casting, weldment, and/or the like. The configuration of the front link arms 52*a*, 52*b* can vary from what is shown.

With continued reference to FIGS. 2 and 3, first and second supporting brackets 74*a*, 74*b* extend upwardly from the forward portion of the respective pedal members 44*a*, 44*b*. In the illustrated embodiment, the supporting brackets 74*a*, 74*b* each include a frame member 76 having opposing sides 78*a*, 78*b* coupled to the corresponding pedal members 44*a*, 44*b*. A rib 80 extends between the sides 78*a*, 78*b* and provides stability.

With continued reference to FIGS. 2 and 3, first and second adjustment devices 82*a*, 82*b* are configured to adjust and set the position of the pedal members 44*a*, 44*b* relative to the rocker arms 38*a*, 38*b*, respectively, which as explained further herein below changes a shape of the above-noted elliptical path. More particularly, the first and second adjustment devices 82*a*, 82*b* are specially configured to adjust and set the position of the first pivot axis 54 relative to the pedal members 44*a*, 44*b*. In the illustrated embodiment, each of the adjustment devices 82*a*, 82*b* includes a linear actuator 84 that is extendable and retractable, which as explained further herein below with reference to FIGS. 4-6 thereby adjusts the relative position of the first and second pivot axes 54, 58. The linear actuator 84 includes a conventional bi-directional electric motor 86 mounted to a gearbox 88. The gearbox 88 is pivotally coupled to a respective front link arm 52*a*, 52*b* at a pivot pin 89 extending between the opposing sides 62*a*, 62*b* of the frame member 61. Thus, each of the adjustment devices 82*a*, 82*b* are coupled to the respective front link arms 52*a*, 52*b* at a respective first adjustment device pivot axis 53 (see FIG. 2). The type and configuration of the linear actuator 84 can vary from what is shown and described. In other embodiments, the linear actuator 84 could include a worm gear with a right-angle motor.

The gearbox 88 contains a gear set (not shown) that connect an output shaft (not shown) of the electric motor 86 to a first end portion of a positioning screw 90, which is disposed in the gearbox 88. Operation of the electric motor 86 causes rotation of the motor output shaft, which in turn operates the gear set, which in turn causes rotation of the positioning screw 90. A second end portion 71 of the positioning screw 90 is engaged via a threaded engagement with an engagement nut 92 that is pivotally mounted within the respective first or second supporting brackets 74*a*, 74*b*. Thus, each adjustment device 82*a*, 82*b* is coupled to a respective one of the pedal members 44*a*, 44*b* at a second adjustment device pivot axis 55 (see FIG. 2), which is located above and rearwardly of the second pivot axis 58. The adjustment device pivot axes 53, 55 are located vertically between the first and second pivot axes 54, 58. Each of the adjustment devices 82*a*, 82*b* extends along a respective adjustment device axis 94 (see FIG. 2), which in this embodiment exactly and/or nearly intersects with the first pivot axis 54. This can vary from what is shown.

With continued reference to FIGS. 2 and 3, operation of the electric motor 86 in a first direction causes rotation of the positioning screw 90 about its own axis in a first direction and operation of the electric motor 86 in an opposite direction causes opposite rotation of the positioning screw 90 about its own axis in an opposite, second direction. Rotation of the positioning screw 90 in the first direction causes the positioning screw 90 to travel outwardly relative to the engagement nut 92, thus lengthening the linear actuator 84. Rotation of the positioning screw 90 in the second direction causes the positioning screw 90 to travel further into engagement with the engagement nut 92, thus shortening the linear actuator 84.

Figure 4:
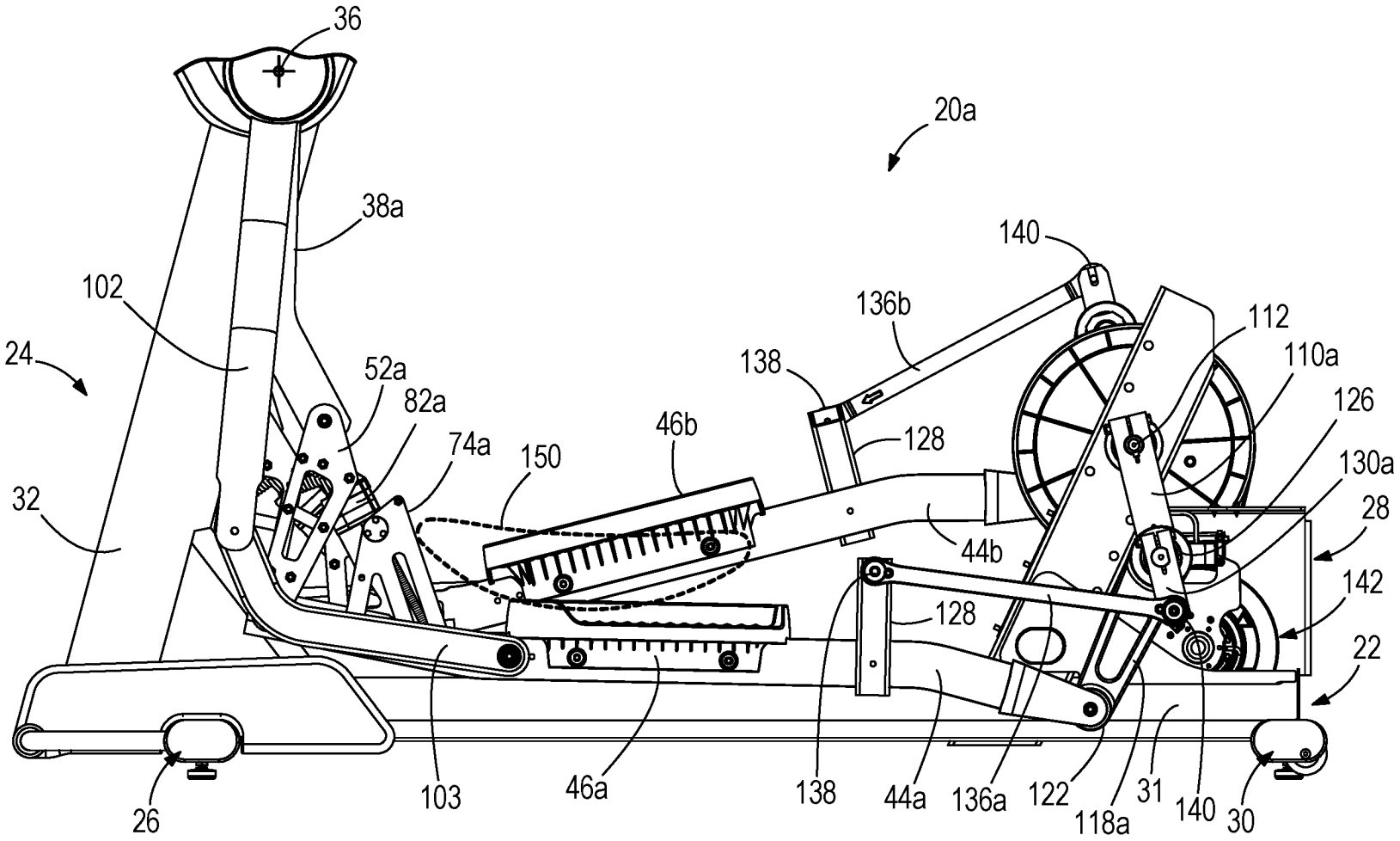
FIG. 4 is a side view, showing an elliptical path of a foot pad when adjustment devices on the foot pedal members are retracted.
Figure 5:
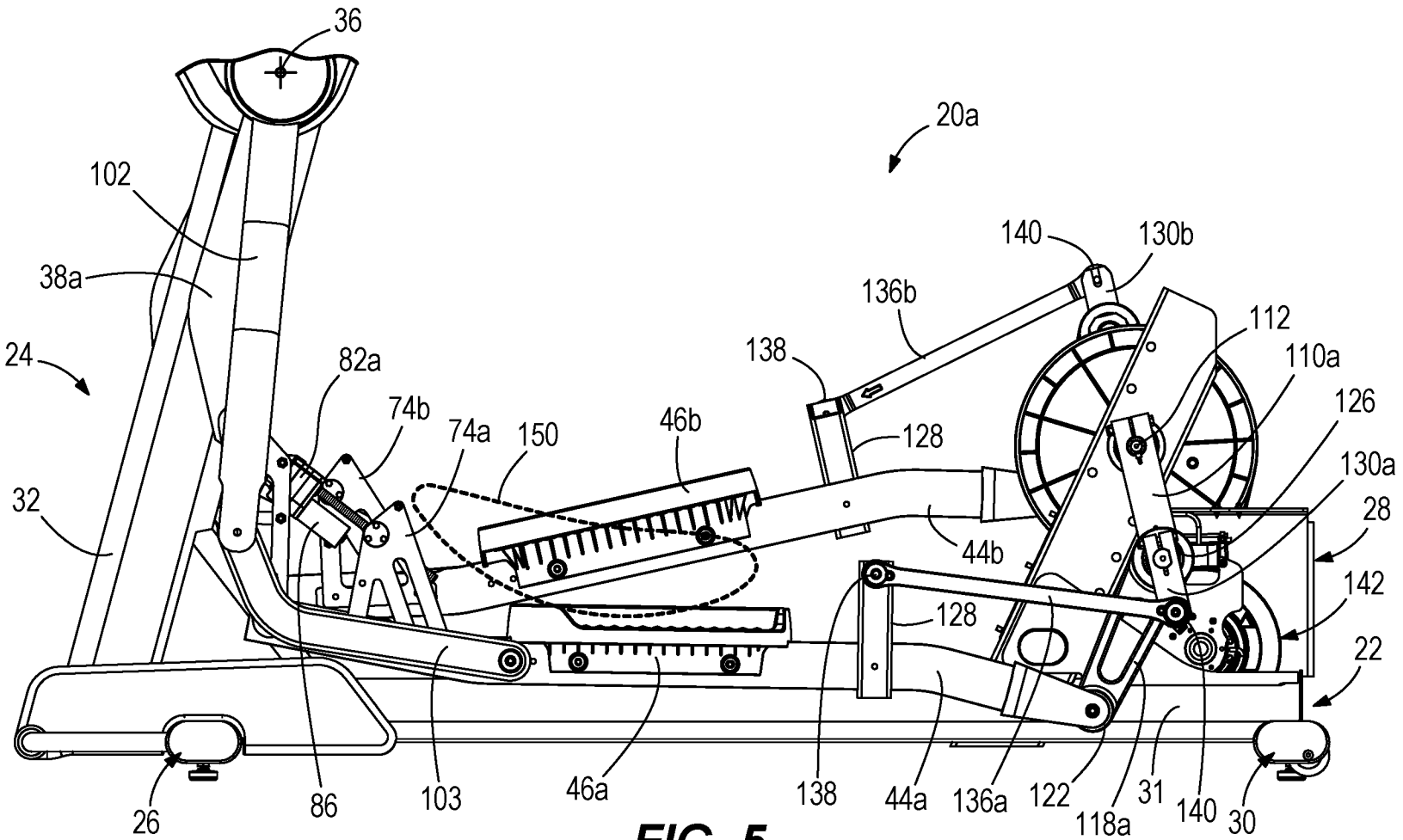
FIG. 5 is a view like FIG. 4, showing the elliptical path when the adjustment devices are partially extended.
Figure 6:
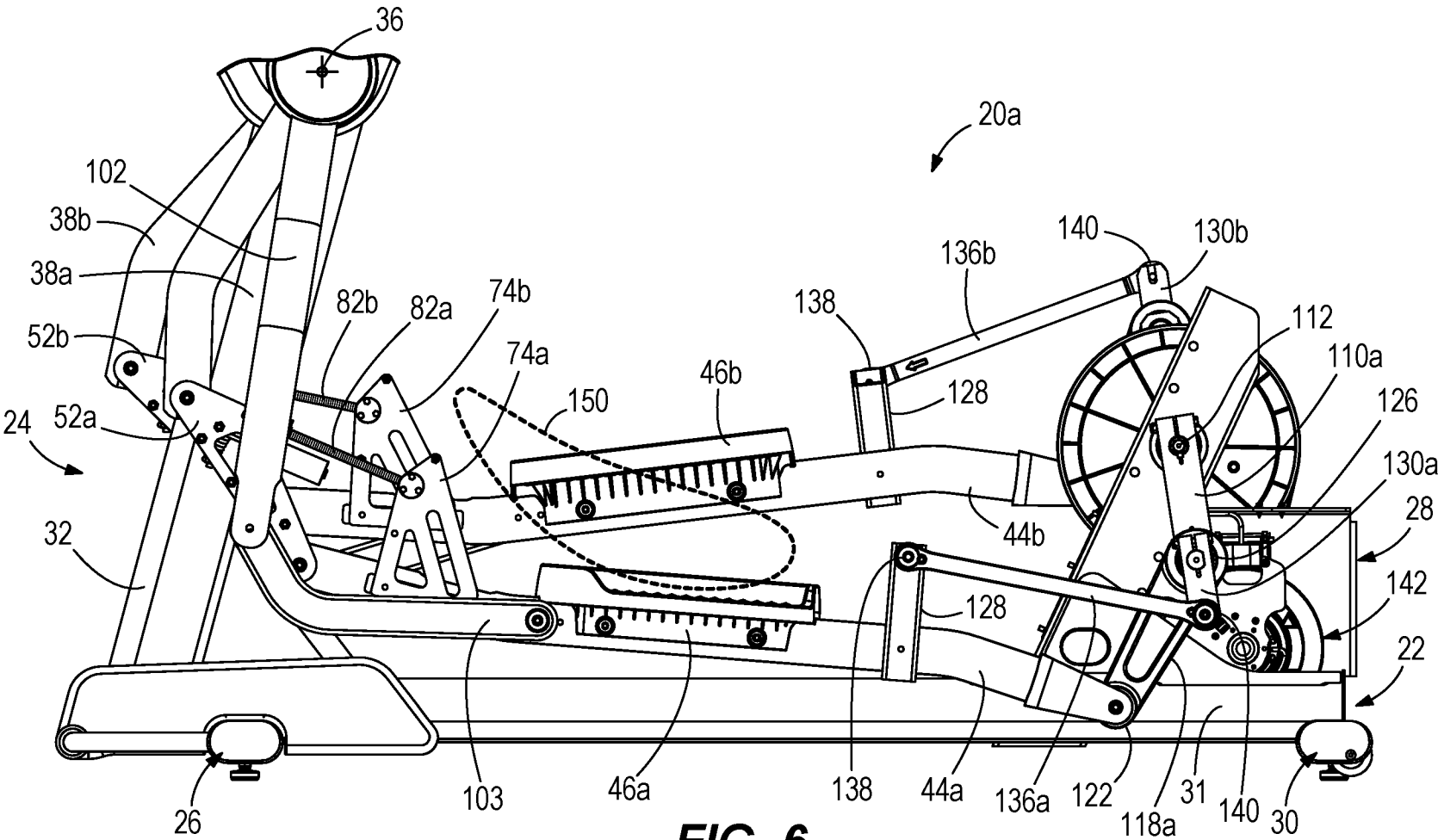
FIG. 6 is a view like FIG. 4, showing the elliptical path when the adjustment devices are fully extended.
Figure 7:
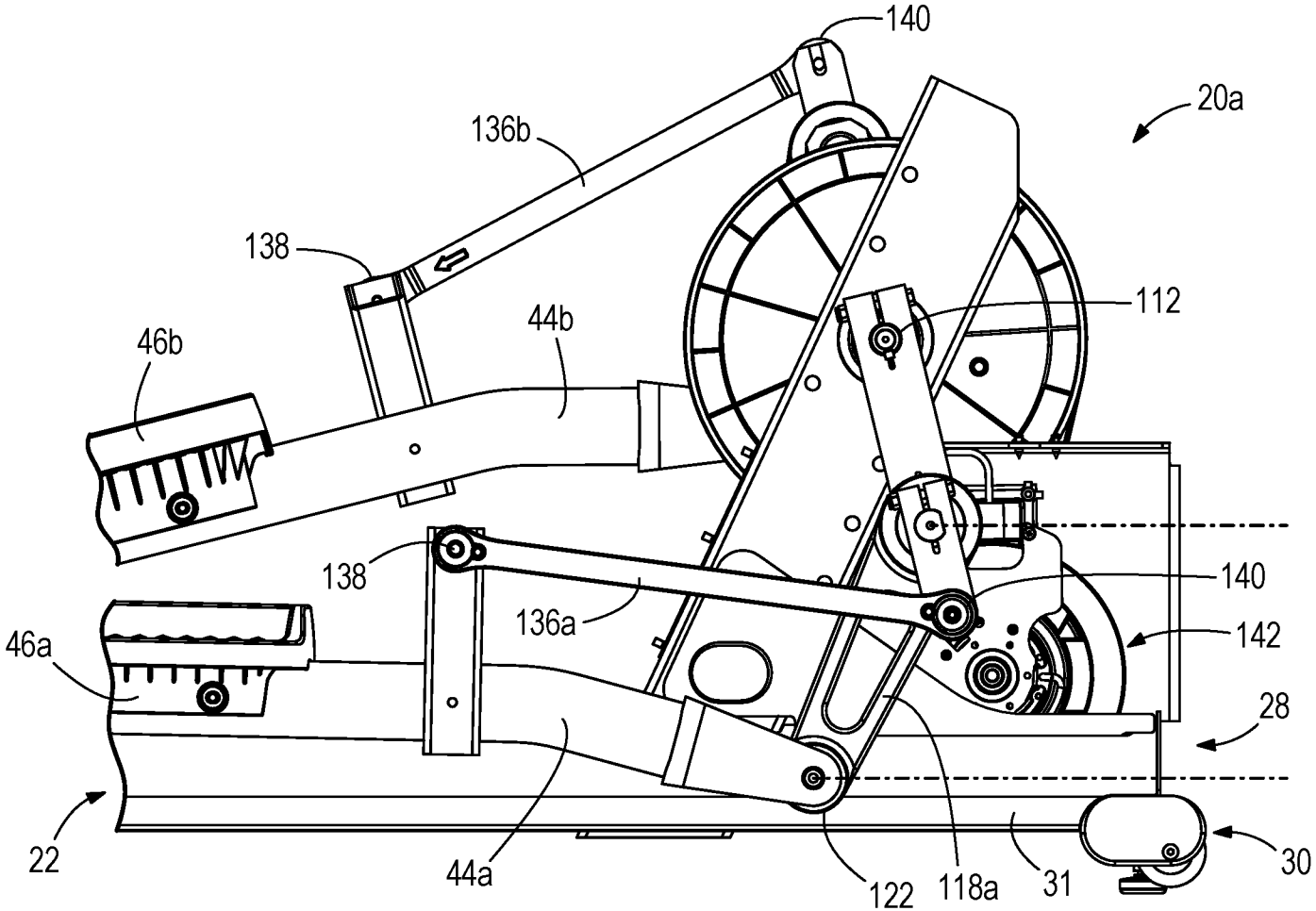
FIG. 7 is a closer view of rear portions of the exercise machine.
Figure 8:
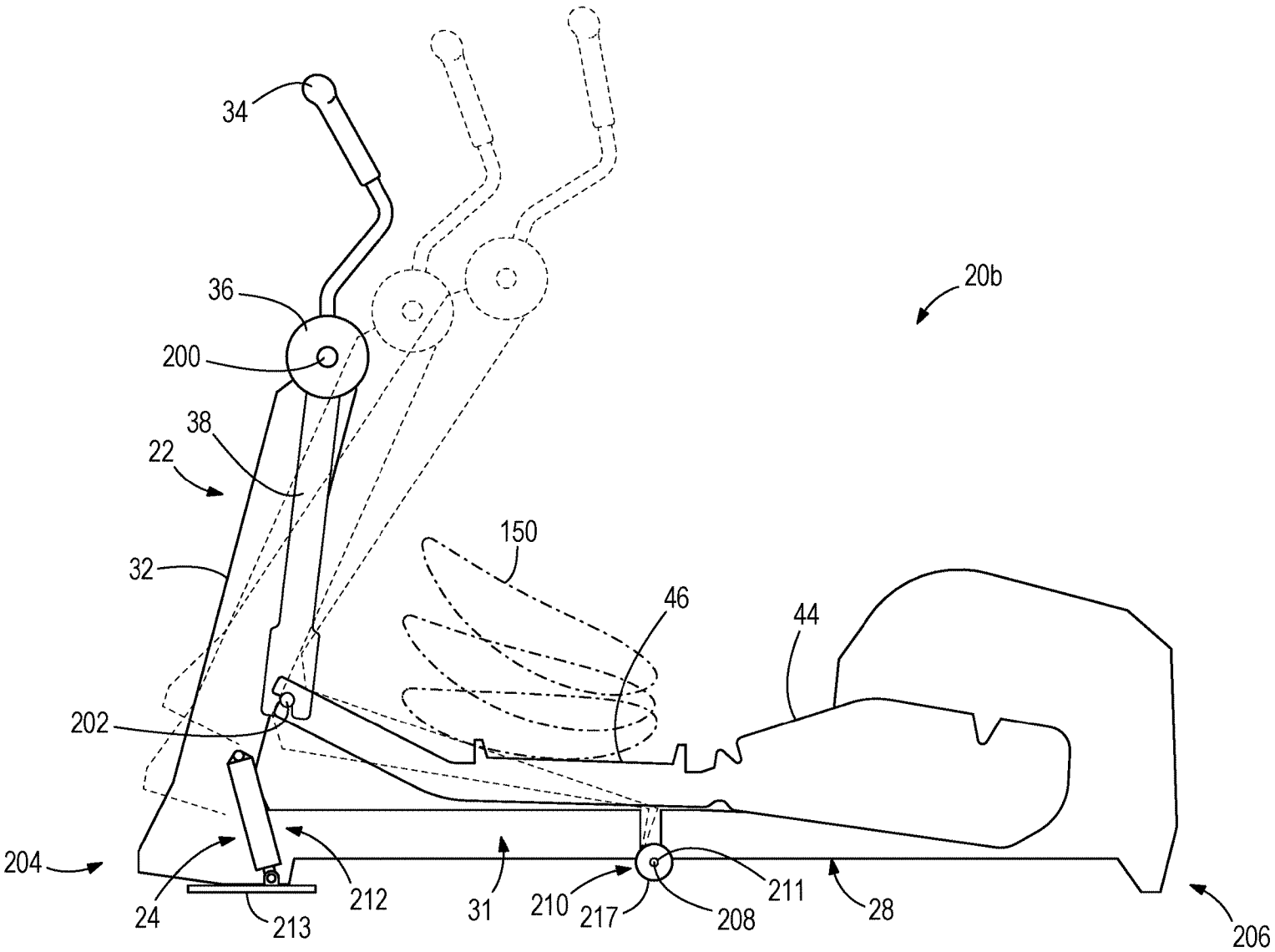
FIGS. 8-12 are side views of a second embodiment of an exercise machine having an adjustment device configured according to the present disclosure to pivot a first frame portion relative to a second frame portion to thereby adjust an elliptical striding motion of the user.

Referring to FIGS. 1 and 2, the exercise machine 20*a* also includes first and second handle members 96 that are configured for manual engagement during the striding exercise motion. The first and second handle members 96 are pivotally coupled to the frame 22 along the stationary shaft 36 and have upper handle portions 98 that extend upwardly from the stationary shaft 36 from respective pivot bearings 100 journaled on and pivotable about the stationary shaft 36. In this way, the upper handle portions 98 are pivotable forwardly and rearwardly with respect to the stationary shaft 36 during the striding exercise motion. The handle members 96 each have a lower end portion 102 that is pivotally coupled to an L-shaped connecting link 103, which in turn is coupled to a corresponding front portion of one of the pedal members 44*a*, 44*b*, and more specifically along a handle member pivot axis 104 (see FIG. 2) that is located rearwardly of the second pivot axis 58. By coupling to the first and second pedal members 44*a*, 44*b*, the range of motion of the handle members 96 is virtually unaffected by changing the elliptical path 150 (FIGS. 4-6). In other words, adjustment of the position of the pivot axis 54 relative to the respective pedal member 44*a*, 44*b* via the adjustment device 82*a*, 82*b* changes the shape of the elliptical path 150, but not the arc or range of motion of the handle members 96. The shape and configuration of the connecting link 103 can vary from what is shown.

Figure 16:
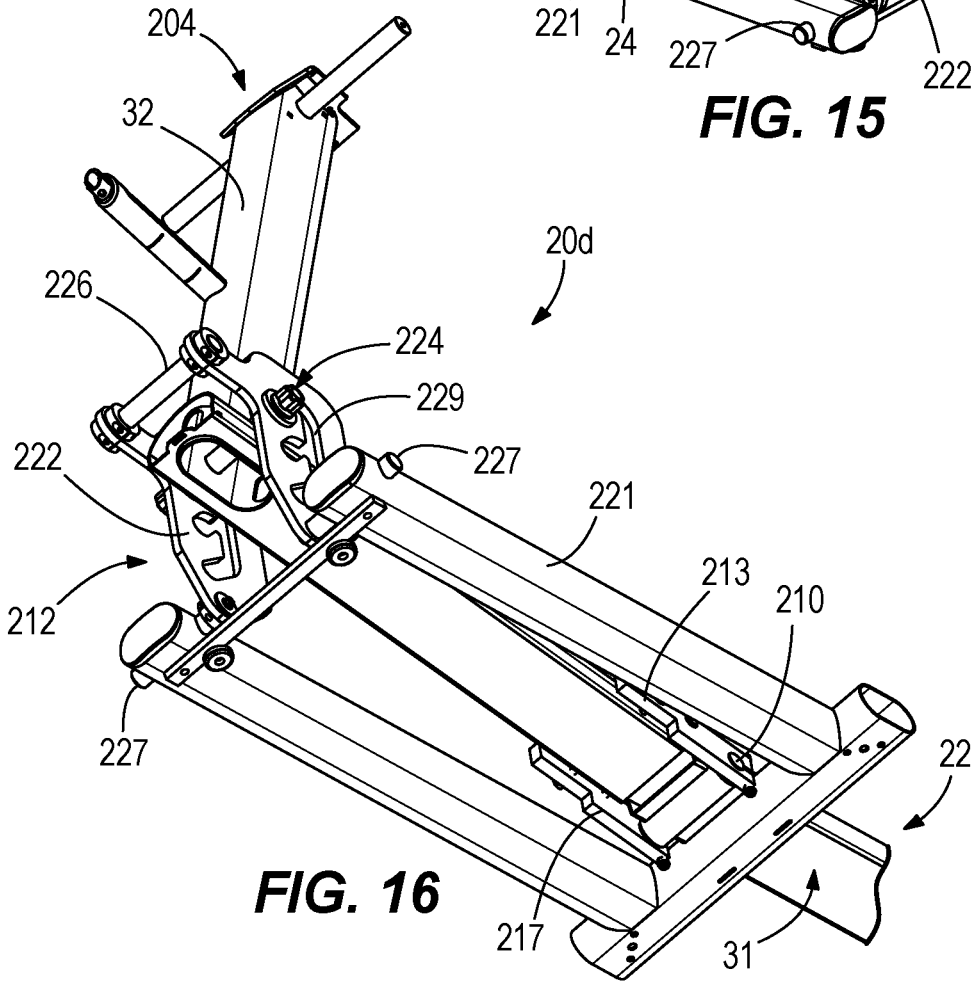
FIG. 16 is a bottom perspective view of the adjustment device of the fourth embodiment.
Figure 17:
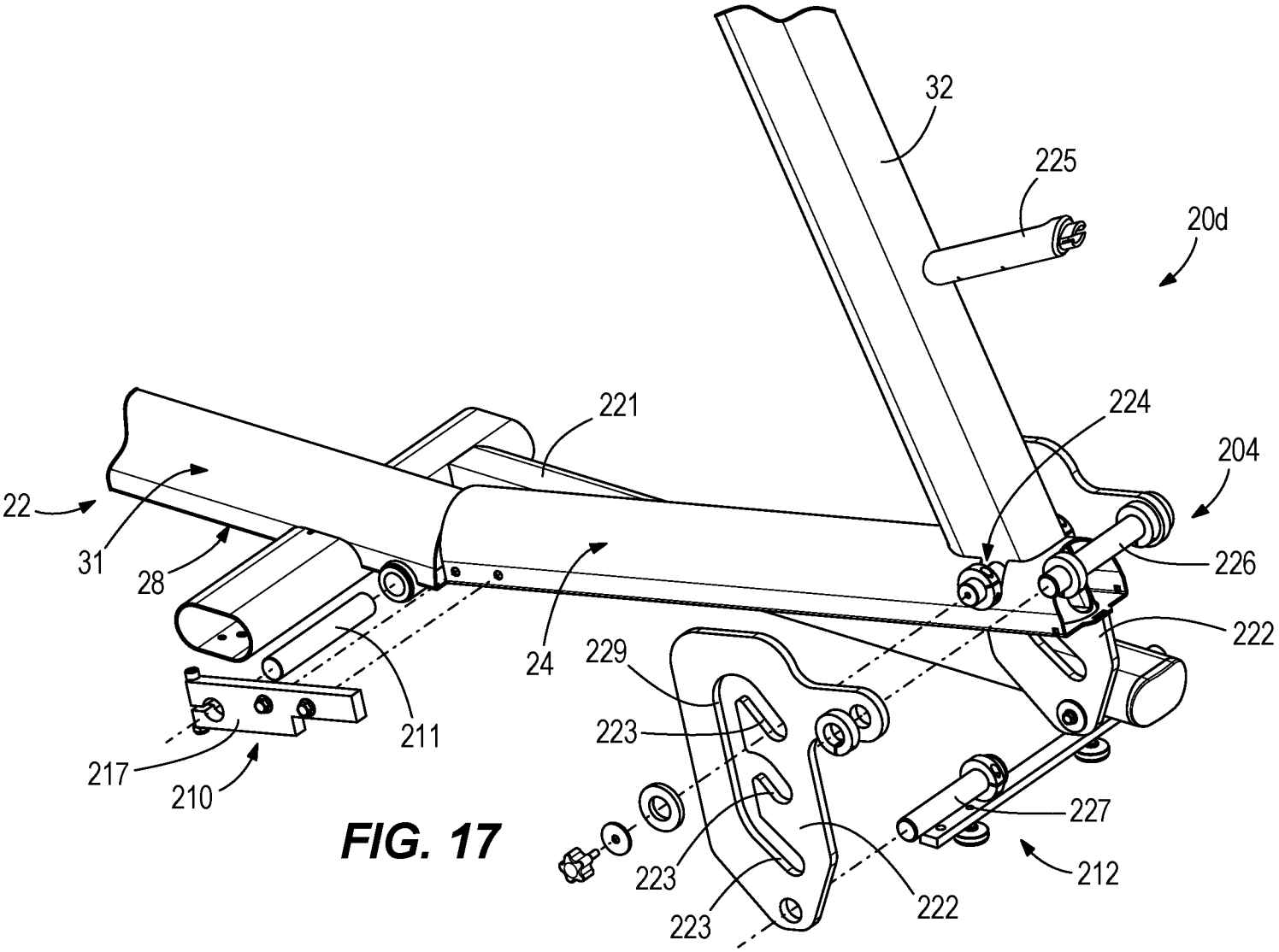
FIG. 17 is an exploded view of the adjustment device of the fourth embodiment.

Referring now to FIGS. 2, 3, 6, and 7, the rear frame portion 28 supports the rear portions of the respective pedal members 44*a*, 44*b*. Specifically, first and second crank arms 110*a*, 110*b* each have a first end portion 112 that is pivotally coupled to a stanchion 114 that upwardly extends on the rear frame portion 28. The crank arms 110*a*, 110*b* are keyed together so that they remain 180 degrees apart from each other during operation of the exercise machine 20*a*. The first end portions 112 of the crank arms 110*a*, 110*b* are coupled together along a common crank axis 116. First and second rear link arms 118*a*, 118*b* pivotally couple the crank arms 110*a*, 110*b* to the rear portions of the respective pedal members 44*a*, 44*b*. As further explained herein below, the rear link arms 118*a*, 118*b* facilitate adjustment of the pedal members 44*a*, 44*b* relative to the crank arms 110*a*, 110*b* when the position of the pedal members 44*a*, 44*b* relative to the rocker arms 38*a*, 38*b* is adjusted via the adjustment devices 82*a*, 82*b*. The crank arms 110*a*, 110*b* each have a second end portion 120 that is pivotally coupled to a respective one of the rear link arms 118*a*, 118*b*. The rear link arms 118*a*, 118*b* each have a first end portion 122 that is pivotally coupled to the rear portion of the pedal members 44*a*, 44*b* at a pedal-link arm pivot axis 124, and a second end portion 126 that is pivotally coupled to the first and second crank arms 110*a*, 110*b* along a pedal-crank pivot axis 125. In this embodiment, the pedal-link arm pivot axis 124 is located vertically below the common crank axis 116 so that the rear link arms 118*a*, 118*b* are subjected to tension forces from the weight of the user standing on the foot pads 46*a*, 46*b*; however this can vary, as will be evident from the alternate embodiment described herein below with respect to FIGS. 16 and 17.

With continued reference to FIGS. 2, 3, 6, and 7, first and second crank extensions 130*a*, 130*b* axially extend from the second end portions 120 of the crank arms 110*a*, 110*b*, respectively. The crank extensions 130*a*, 130*b* are coupled to the crank arms 110*a*, 110*b* via a keyed shaft 131 on the respective crank arms 110*a*, 110*b* and a corresponding slotted keyhole 134 formed in the crank extensions 130*a*, 130*b*. Thus, the crank extensions 130*a*, 130*b* rotate with and remain parallel with the crank arms 110*a*, 110*b*, as the crank arms 110*a*, 110*b* are rotated about the common crank axis 116.

The rear portions of the pedal members 44*a*, 44*b* each have an upwardly extending extension member 128 that extends transversely upwardly relative to the respective pedal member 44*a*, 44*b*. First and second guide members 136*a*, 136*b* each have a first guide end portion 138 pivotally coupled to the extension member 128 on a respective rear portion of the respective pedal member 44*a*, 44*b* and a second guide end portion 140 pivotally coupled to a respective one of the crank extensions 130*a*, 130*b*. A conventional resistance mechanism 142 (e.g., hybrid generator-brake) is mounted to the frame 22 at the rear frame portion 28 and coupled to the crank arms 110*a*, 110*b* so as to provide resistance to rotation of the crank arms 110*a*, 110*b* about the common crank axis 116 and optionally generating power based upon the rotation for powering, for example, the electric motor 86. The resistance mechanism 142 is a conventional item and thus is not further described herein for the sake of brevity. A suitable resistance mechanism 142 is the FB 6 Series sold by Chi Hua.

Referring to FIG. 1, the exercise machine 20*a* further includes a controller 144 that is configured to control the adjustment devices 82*a*, 82*b* to actively adjust the shape of the elliptical path. Optionally, the controller 144 can be powered by the resistance mechanism 142, and/or a battery, and/or another electric power source. In the illustrated embodiment, the controller 144 is configured to control the electric motor 86 and particularly to cause the electric motor 86 to operate and cause rotation of the positioning screw 90, as described herein above. The controller 144 can include a programmable processor, a memory, and an input/output device. The processor is communicatively connected to a computer readable medium that includes volatile or non-volatile memory upon which computer readable code is stored. The processor can access the computer readable code on the computer readable medium, and upon executing the code, can send signals to carry out functions according to the methods described herein below. In the illustrated embodiment, execution of the code allows the controller 144 to control (e.g. actuate) the electric motor 86.

The exercise machine 20*a* further includes a user input device 146. Optionally, the user input device 146 can be powered by the resistance mechanism 142, and/or a battery, and/or another electric power source. The type and configuration of the user input device 146 can vary from what is shown. In the illustrated embodiment, the user input device 146 mounted on the frame 22 and vertically extends above the stationary handles 34 so that a user standing on the foot pads 46*a*, 46*b* can view and manually actuate the user input device 146. In this embodiment, the user input device 146 includes a touch screen that displays operating characteristics of the exercise machine 20*a* and allows the user to manually input commands to the controller 144, in particularly to command the controller 144 to actuate the adjustment devices 82*a*, 82*b* via the electric motor 86. This allows the user to actively adjust the shape of the noted elliptical path of travel of the foot pads 46*a*, 46*b*, as further described herein below.

FIGS. 4-6 depict operation of the exercise machine 20*a* in positions of use, in which the adjustment devices 82*a*, 82*b* are retracted (FIG. 4), partially extended (FIG. 5) and fully extended (FIG. 6). In each position, the elliptical path 150 traveled by the foot pads 46*a*, 46*b* has the same horizontal length. As shown in the figures, the adjustment devices 82*a*, 82*b* advantageously facilitate infinite adjustment of footpath (ellipse) inclination and/or orientation and/or angle. This can be accomplished without the use of ramps or guides. The horizontal length (i.e. the axial length from front to back with respect to the exercise machine 20) of the elliptical path 150 traveled by the foot pads 46*a*, 46*b* remains constant before and after operation of the adjustment devices 82*a*, 82*b*; however in each position of the adjustment devices 82*a*, 82*b*, the shape of the elliptical path 150 is different. In particular, the adjustment devices 82*a*, 82*b* facilitate adjustment and setting of the location of the pedal members 44*a*, 44*b* relative to the rocker arms 38*a*, 38*b*. As these relative positions are changed, so does the vertical displacement of the first pivot axis 54 and second pivot axis 58, which changes shape of the elliptical path 150 along which the foot pads 46*a*, 46*b* move.

As described herein above, the controller 144 can be actuated by the user via the user input device 146 to adjust and set the adjustment devices 82*a*, 82*b* to thereby change the shape of the elliptical path 150. Optionally, the controller 144 can also or alternately be programmed to automatically change the elliptical path 150 depending upon an operational or other characteristic of the exercise machine 20*a* and/or an exercise routine saved in the memory of the controller 144. In some embodiments, changes to the elliptical path 150 can occur before the exercise routine begins. In some embodiments, changes to the elliptical path 150 can occur during the exercise routine or after the exercise routine ends.

As shown in FIGS. 4-6, actively adjusting the adjustment devices 82*a*, 82*b* actively adjusts and sets a relative position of the first and second pivot axes 54, 58. Stated another way, adjusting the adjustment devices 82*a*, 82*b* actively changes an angle at which the front link arms 52*a*, 52*b* extend between the first and second adjustment device pivot axes 53*a*, 53*b*. Changing this angle also causes a change in a fore-aft range of motion through which each of the rocker arms 38*a*, 38*b* pivot with respect to the frame 22 during the striding exercise motion. As described above, adjustment of the position of the pedal members 44*a*, 44*b* relative to the rocker arms 38*a*, 38*b* is facilitated at the rear frame portion 28 by pivoting of the rear link arms 118*a*, 118*b*—without the need for linear guides or other similar bearings. More specifically, the rear link arms 118*a*, 118*b* are pivotally coupled to the pedal members 44*a*, 44*b* and thus adjustment of the position of the pedal members 44*a*, 44*b* is accommodated by pivoting of the rear link arms 118*a*, 118*b* about the respective pedal-link arm axis 124 and pedal-crank pivot axis 125.

Thus it can be seen that embodiments in the present disclosure facilitate active adjustment of the shape of the elliptical exercise motion without the need for rollers and tracks, or linear bearings and guides, which can require additional maintenance and cause undesirable noise.

During further research and development, the present inventors conceived of the embodiments shown in FIGS. 8-19, which advantageously allow for adjustment of the noted elliptical footpath orientations and/or angle of inclination of the footpath. The same reference numbers used for the embodiments of FIGS. 1-7 are used in FIGS. 8-19 to refer to the same or similar features. As further described herein below, exercise machines 20*b*-20*d* are also configured so as to enable the user to adjustably vary the fore-aft (i.e., longitudinal) position of the rocker arm pivot axis 200, which in turn changes the shape and/or incline of the elliptical path 150.

In the embodiment shown in FIGS. 8-12, an exercise machine 20*b* has a frame 22, pedal members 44, and foot pads 46 on the pedal members 44. The foot pads 46 are each movable along an elliptical path 150 during a striding exercise motion. The exercise machine 20*b* has rocker arms 38, which each have a first end that is pivotable with respect to the frame 22 about a rocker arm pivot axis 200, and a second end that is pivotable with respect to one of the pedal members 44 about a pedal lever hub axis 202, particularly through an angular displacement range, examples of which are shown in dash-and-dot lines in FIGS. 8-12. The frame 22 includes first (front) and second (rear) frame portions 204, 206. In this embodiment, the first frame portion 204 includes the support column 32, which supports the rocker arms 38. The second frame portion 206 is shown schematically but can be configured like the embodiment shown in FIG. 7.

The first and second frame portions 204, 206 are coupled together in a novel way via a frame pivot joint 210, which in the illustrated example includes a laterally extending pivot pin 211 journaled in a connecting bracket 217. The frame pivot joint 210 allows the first frame portion 204 to be pivoted upwardly and downwardly about a frame pivot axis 208 relative to the second frame portion 206. The first and second frame portions 204, 206 include a front and rear portion of the base member 31, respectively. As shown in the figures, the second frame portion 206 remains stationary on the supporting surface during pivoting motion of the first frame portion 204. The configuration of the pivot joint 210 can vary and for example can be any conventional pivot joint that facilitates a robust connection of the first and second frame portions 204, 206, and also facilitates pivoting of the first frame portion 204 relative to the second frame portion 206, while for example the second frame portion 206 remains stationary on the supporting surface.

In the illustrated embodiment, the support column 32 is fixed to the base member 31 forwardly of the frame pivot axis 208. The frame pivot joint 210 and associated frame pivot axis 208 are located near the middle of the frame 22. As such, the support column 32 pivots along with the rest of the first frame portion 204. In the illustrated example, the frame pivot axis 208 is located rearwardly of the support column 32 and rearwardly of the elliptical path 150. The frame pivot axis 208 is located forwardly of the rear of the exercise machine 20*b*. The frame pivot axis 208 is located about midway along the length of the pedal members 44. The frame pivot axis 208 is located adjacent to the supporting surface and extends laterally through the first and second frame portions 204, 206; however the location of the frame pivot joint 210 and frame pivot axis 208 can vary from what is shown.

Figure 11:
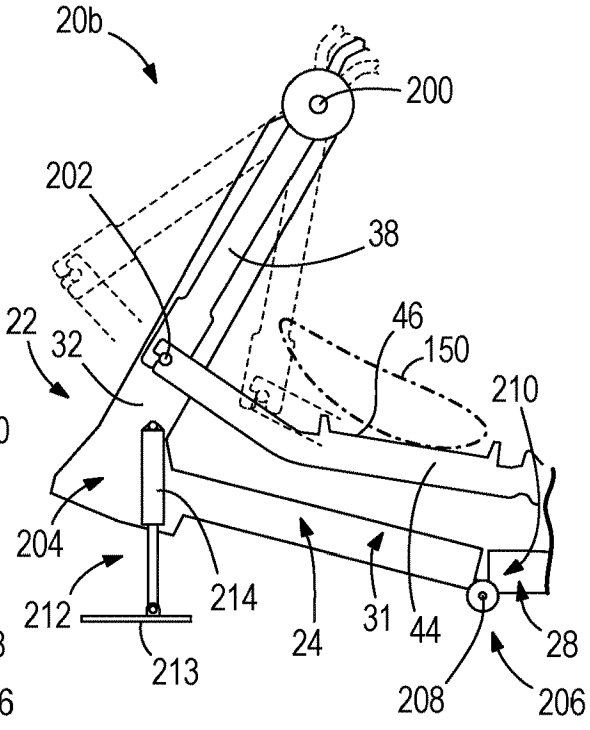
Figure 10:
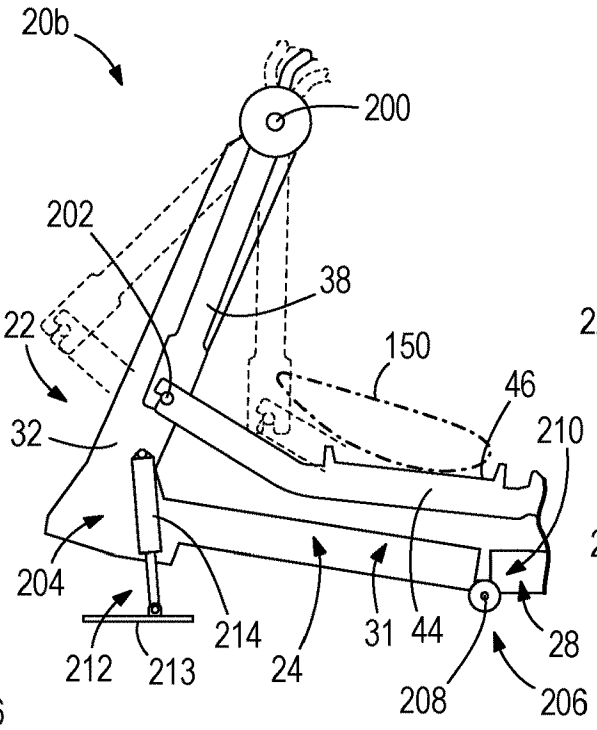
Figure 9:
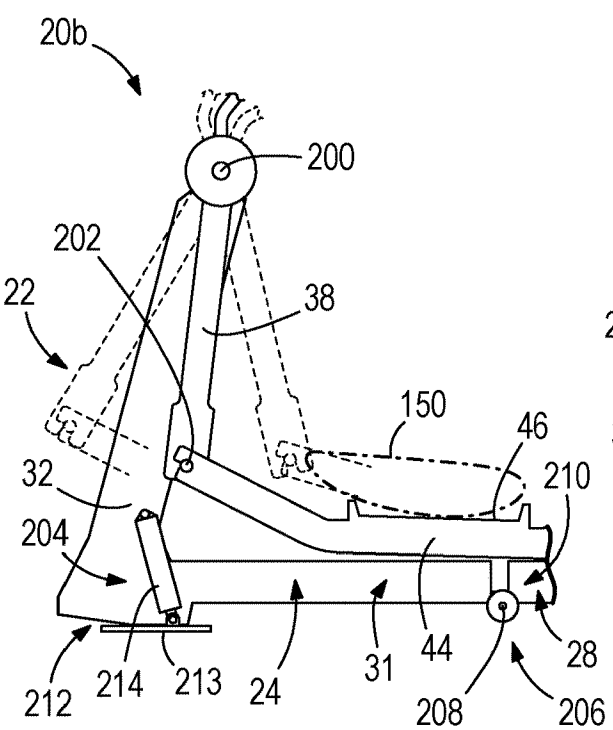
Figure 12:
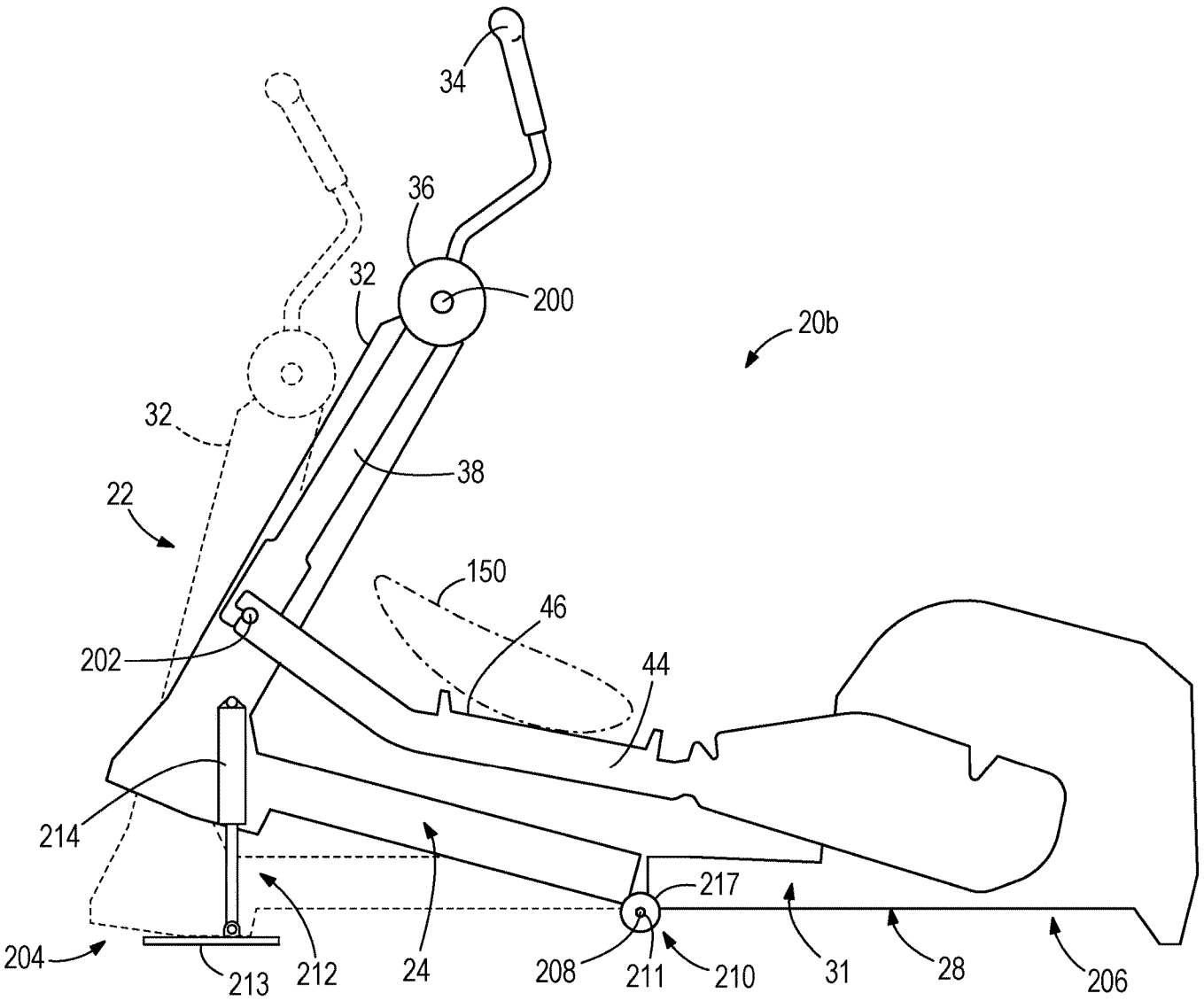

Pivoting the first frame portion 204 relative to the second frame portion 206 about the frame pivot axis 208 adjusts the longitudinal and vertical position of the rocker arm pivot axis 200, which in turn changes the shape of the elliptical path 150, as shown in dash-and-dot lines in FIGS. 8-12. In other words, changing the position of the rocker arm pivot axis 200 changes the rotational position of the rocker arm's angular displacement range relative to the frame 22. As the rotational position of the rocker arm's angular displacement range relative to the frame is varied, the vertical displacement of the pedal lever hub axis 202 also varies. This changes the elliptical path 150. FIG. 9 shows the first frame portion 204 in a fully lowered position relative to the second frame portion 206. FIG. 10 shows the first frame portion 204 in a partially raised position relative to the second frame portion 206. FIG. 11 shows the first frame portion in a fully raised position relative to the second frame portion 206.

Adjusting the position of the rocker arm pivot axis 200 also changes a for-aft range of motion (i.e., rocker swing range) through which the rocker arms 38 pivot during the striding exercise motion, as shown by comparison of the dashed lines in FIGS. 9-11, but does not substantially change a horizontal length of the elliptical path 150. For a rear drive exercise machine, changes to the path of the pedal lever hub axis 202 result in a change to the front of the elliptical path 150 but result in only minimal change to the rear of the elliptical path 150, thus effectively varying the overall incline of the elliptical path 150.

An adjustment mechanism 212 is provided for actively pivoting of the first frame portion 204 relative to the second frame portion 206 about the frame pivot axis 208. The type and configuration of the adjustment mechanism 212 can vary, for example including an electro-mechanical actuator as described herein above with reference to FIGS. 2 and 3. In FIGS. 8-12, the adjustment mechanism 212 is a linear actuator 214 such as for example one or more extendable and retractable hydraulically actuated piston rod and cylinder devices having an upper end pivotably coupled to a forward portion of the first frame portion 204 and an opposite lower end pivotably coupled to a stationary base plate 213 on the ground surface. The linear actuator 214 can for example be controlled by the above-described controller 144 in conjunction with a conventional hydraulic pump (not shown) that controls hydraulic fluid pressure in the linear actuator 214 to automatically extend and/or retract the rod, for example according to stored exercise program in the controller 144 and/or based on a user input to the controller 144 via the user input device 146.

Figure 13:
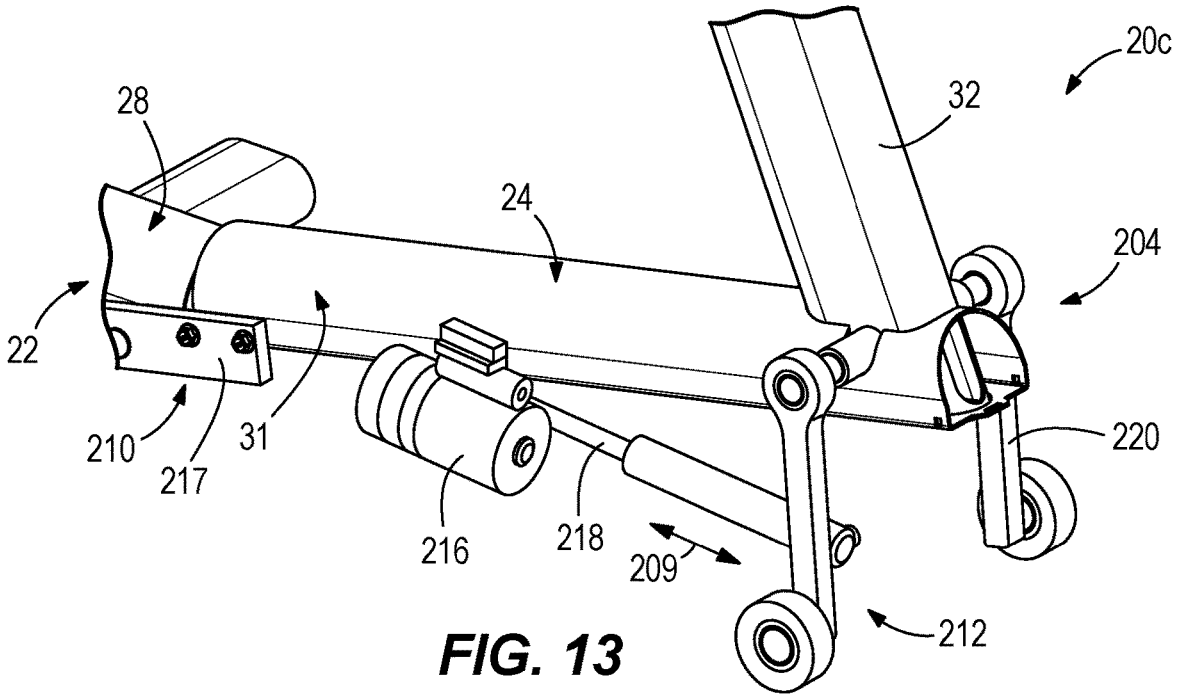
FIGS. 13-14 are front perspective views of two different adjustment devices according to a third embodiment of an exercise machine according to the present disclosure.
Figure 14:
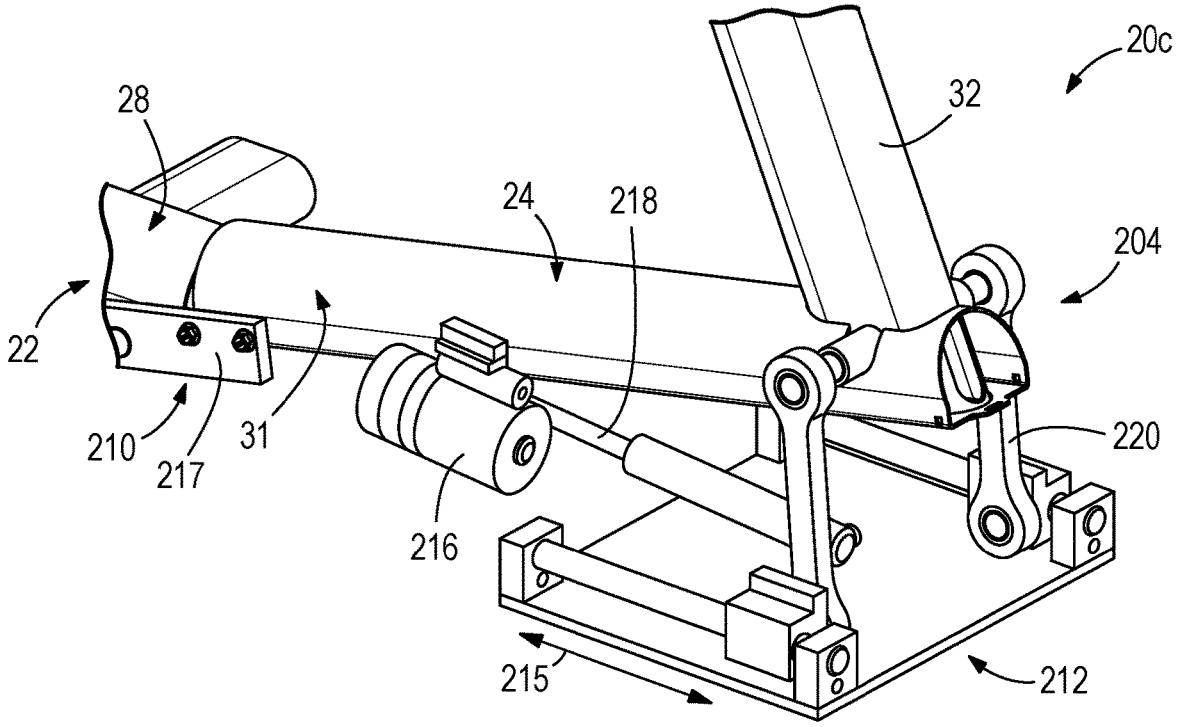
Figure 15:
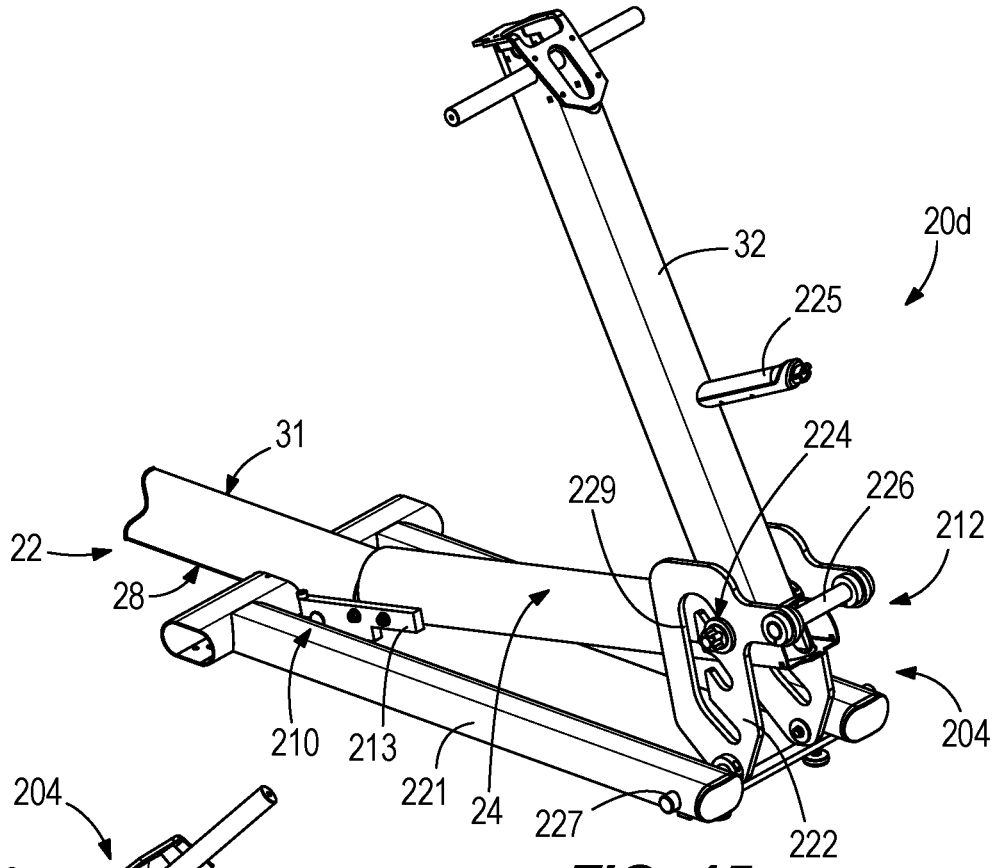
FIG. 15 is a front perspective view of an adjustment device according to a fourth embodiment of an exercise machine according to the present disclosure.

FIGS. 13-14 show an embodiment 20*c* wherein the adjustment mechanism 212 includes a conventional electric motor 216 and an output shaft 218 coupled to pivot arms 220, which can be supported by wheels (FIG. 13) and/or on a base plate with slide bearings (FIG. 14). Operation of the electric motor 216 extends and retracts the output shaft 218, via for example a worm gear engagement or a screw and nut arrangement/engagement, which pivots the pivot arms 220 about their upper ends to raise/pivot the first frame portion 204 and lower/pivot the first frame portion 204. In the embodiment of FIG. 13, the wheels facilitate fore-aft and thus pivoting motion of the pivot arms 220 relative to the frame in the direction of double-headed arrow 209. In the embodiment of FIG. 14, the slide bearings facilitate the fore-aft pivoting motion in the direction of double-headed arrow 215.

FIGS. 15-19 depict an embodiment 20*d* which has a manually operable adjustment mechanism 212, including a laterally extending support bar 224 (e.g., fastener) on the support column 32, which is positionable in each of a series of angular, aligned slots 223 (see FIG. 17) in a support bracket 222. The support bracket 222 is pivotably coupled to the first frame portion 204 by a base frame 221 which extends forwardly from the first frame portion 204. The support bracket 222 is pivotable relative to the base frame 221 about laterally extending fasteners 227. Thus, the support column 32 can be manually raised and lowered relative to the rest of the frame 22, into and out of the various vertical positions, as defined by the aligned slots 223 in the support bracket 222.

Figure 18:
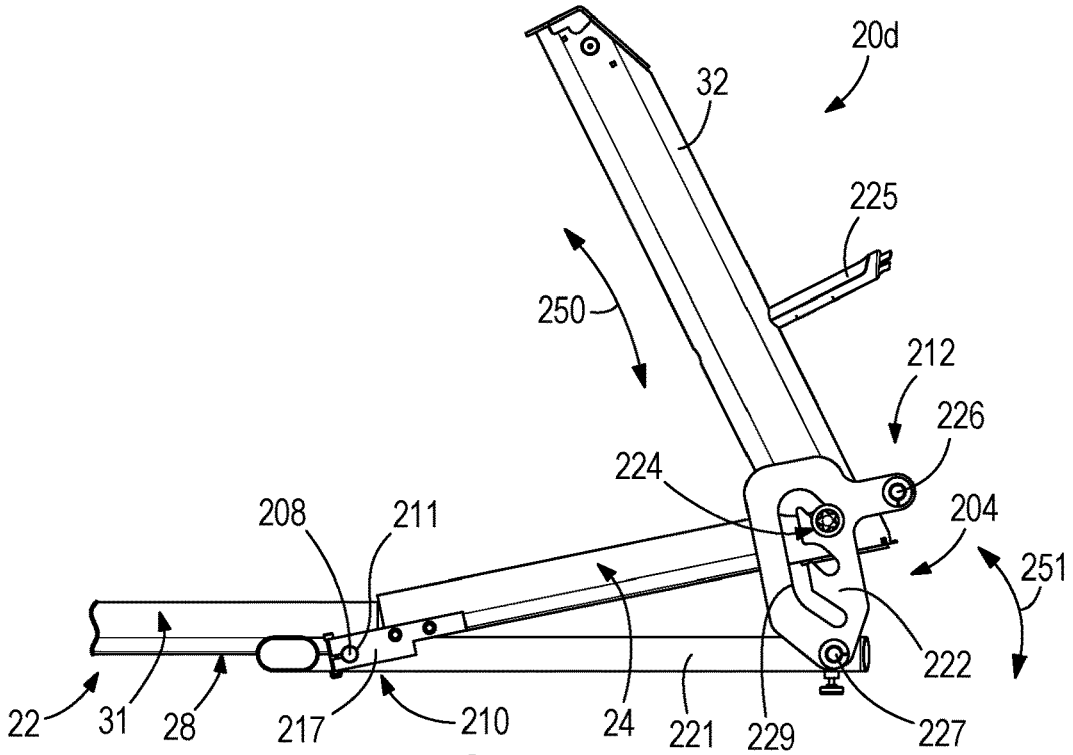
FIG. 18 is a side view of the adjustment device of the fourth embodiment.
Figure 19:
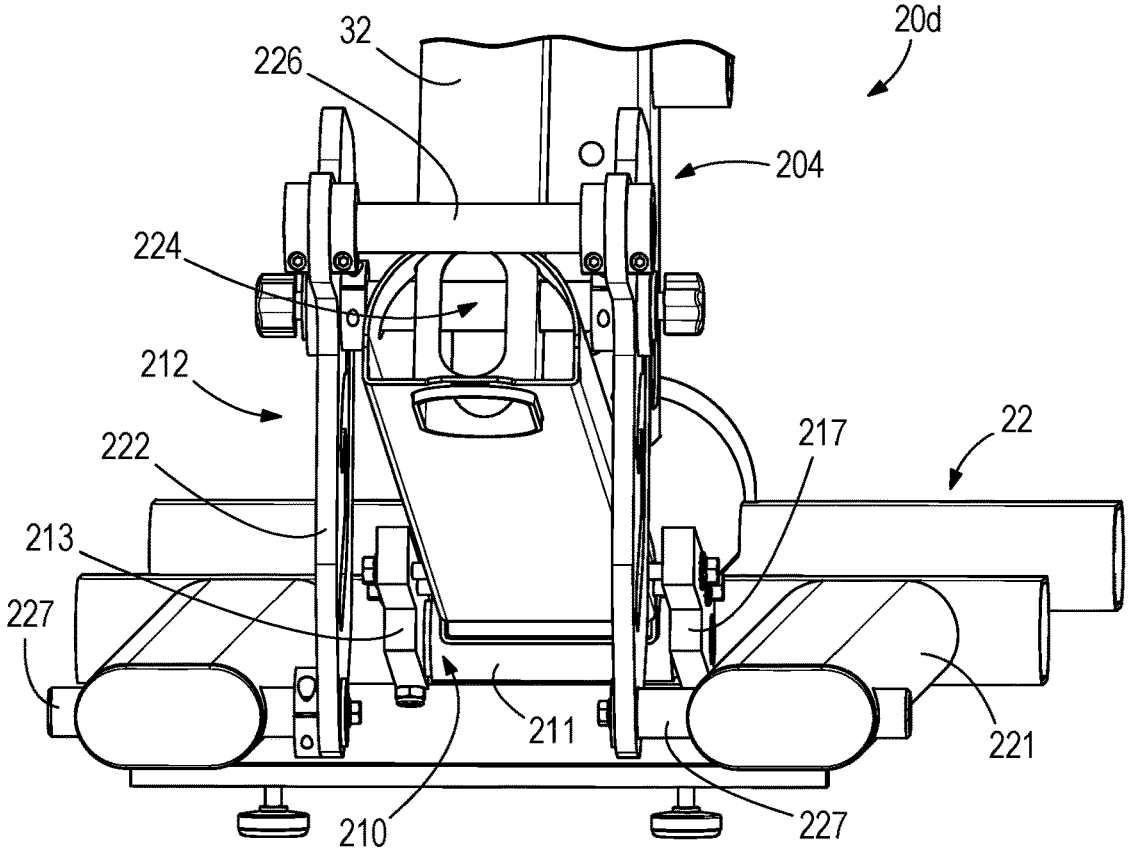
FIG. 19 is a front perspective view of the fourth embodiment.

In use, the operator manually grasps a handle 225 on the front of the support column 32 and raises and/or lowers the support column 32, as shown by double-headed arrow 250 in FIG. 18. The user also manually grasps the handle 226 on the support bracket 222 to pivot the support bracket 222 away from the support column 23, as shown by double-headed 251 in FIG. 18. This moves the support bar 224 out of the respective slot 223. The user is then free to raise and/or lower the support column 32, which moves the support bar 224 along a vertical slot 229 in the support bracket 222 and into alignment with another a new slot 223. The user can then pivot the support bracket 222 back towards the support column 32, which engages the support bar 224 in the new slot 223.

It is presently contemplated that aspects of each of the above described embodiments are combinable to form another embodiment. For example, aspects of the embodiment 20*b* could be implemented in combination with the second and/or third embodiments 20*c*, 20*d*, and so forth. Even more specifically, it is presently contemplated that the rear portions of the exercise machines disclosed in FIGS. 1-7 could be implemented with the front portions of the exercise machines shown in FIGS. 8-19. It is presently contemplated that the pivotable first and second frame members of the embodiments shown in FIGS. 8-19 can be implemented with the adjustment mechanisms of FIGS. 1-7, and so forth.

Although specific advantages have been enumerated above, various embodiments may include some, none, or all the enumerated advantages. Other technical advantages may become readily apparent to one of ordinary skill in the art after review of the following figures and description. Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order.

What is claimed is:

1. An exercise machine for performing a striding exercise motion, the exercise machine comprising:

a longitudinally extending frame;

first and second pedal members;

first and second foot pads on the first and second pedal members, respectively, each of the first and second foot pads being movable along an elliptical path during said striding exercise motion; and first and second rocker arms each having a first end that is pivotable with respect to the frame about a rocker arm pivot axis and further having a second end that is pivotable relative to one of the first and second pedal members about a pedal lever hub axis;

the frame comprising a front frame portion and a rear frame portion located longitudinally rearwardly of the front frame portion, the front frame portion supporting the first and second rocker arms and being pivotable about a frame pivot axis upwardly and rearwardly relative to the rear frame portion while the rear frame portion remains stationary, the frame configured so that pivoting the front frame portion relative to the rear frame portion about the frame pivot axis while the rear frame portion remains stationary adjusts a position of the rocker arm pivot axis, which changes a shape of said elliptical path.

2. The exercise machine according to claim 1, wherein adjusting the position of the rocker arm pivot axis changes a fore aft range of motion through which the first and second rocker arms pivot during the striding exercise motion but does not substantially change a horizontal length of said elliptical path.

3. The exercise machine according to claim 2, further comprising an adjustment mechanism that facilitates pivoting of the front frame portion relative to the rear frame portion about the frame pivot axis.

4. The exercise machine according to claim 3, wherein the front frame portion and the rear frame portion each extend from a front to a rear and are located below the first and second pedal members, and further comprising a support column extending upwardly from the front frame portion and supporting the first and second rocker arms along the rocker arm pivot axis.

5. The exercise machine according to claim 4, wherein the adjustment mechanism comprises a linear actuator having a first end that is pivotably coupled to the front frame portion and having an opposite second end that is pivotably coupled to a base plate for being supported by a surface.

6. The exercise machine according to claim 5, wherein the first end of the linear actuator is pivotably coupled to a forward portion of the front frame portion.

7. The exercise machine according to claim 6, wherein operation of the linear actuator pivots the support column and the front frame portion upwardly and rearwardly together relative to the rear frame portion about the frame pivot axis which adjusts said position of said rocker arm pivot axis.

8. The exercise machine according to claim 3, wherein the adjustment mechanism is manually actuatable.

9. The exercise machine according to claim 3, further comprising a controller configured to automatically actuate the adjustment mechanism based on a user input to a user input device.

10. The exercise machine according to claim 3, further comprising a controller configured to automatically actuate the adjustment mechanism based on a stored program.

11. The exercise machine according to claim 2, wherein the front frame portion and the rear frame portion each extend from a front to a rear and are located below the first and second pedal members, and further comprising a support column extending upwardly from the front frame portion and supporting the first and second rocker arms along the rocker arm pivot axis.

12. The exercise machine according to claim 11, wherein said support column is fixed to the front frame portion at a fixed joint located forwardly of said frame pivot axis.

13. The exercise machine according to claim 12, wherein the frame pivot axis is located rearwardly of the support column.

14. The exercise machine according to claim 11, wherein the support column is coupled to the front frame portion such that the support column and the front frame portion are pivotable upwardly and rearwardly together relative to the rear frame portion about the frame pivot axis while the rear frame portion remains stationary, which adjusts said position of said rocker arm pivot axis.

15. The exercise machine according to claim 2, further comprising a frame pivot joint that facilitates pivoting of the front frame portion relative to the rear frame portion about the frame pivot axis, the frame pivot joint located longitudinally between the front frame portion and the rear frame portion.

16. The exercise machine according to claim 1, wherein the frame is configured so that pivoting the front frame portion relative to the rear frame portion about the frame pivot axis while the rear frame portion remains stationary adjusts an incline of said elliptical path.

17. The exercise machine according to claim 16, wherein said elliptical path has a horizontal length that remains substantially constant when the position of the rocker arm pivot axis is changed.

18. The exercise machine according to claim 1, wherein said elliptical path has a horizontal length that remains substantially constant when the position of the rocker arm pivot axis is changed.

19. The exercise machine according to claim 1, wherein the front frame portion and the rear frame portion are each configured to support the exercise machine relative to a surface, the front frame portion being pivotable about the frame pivot axis upwardly and rearwardly relative to the surface.

20. The exercise machine according to claim 1, further comprising a support column extending upwardly from the front frame portion and supporting the first and second rocker arms along the rocker arm pivot axis, the support column pivoting with the front frame portion about the frame pivot axis upwardly and rearwardly relative to the rear frame portion.

* * * * *